US008174466B2

(12) United States Patent
Toyomura et al.

(10) Patent No.: US 8,174,466 B2
(45) Date of Patent: May 8, 2012

(54) DISPLAY DEVICE AND DRIVING METHOD THEREOF

(75) Inventors: Naobumi Toyomura, Kanagawa (JP); Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 1088 days.

(21) Appl. No.: 12/068,793

(22) Filed: Feb. 12, 2008

(65) Prior Publication Data

US 2008/0198103 A1 Aug. 21, 2008

(30) Foreign Application Priority Data

Feb. 20, 2007 (JP) ..... 2007-038863

(51) Int. Cl.
*G09G 3/30* (2006.01)

(52) U.S. Cl. ..... 345/76; 345/77; 345/78; 345/82; 345/204; 315/169.3

(58) Field of Classification Search ..... 345/76–83, 345/204–215; 315/169.3
See application file for complete search history.

(56) References Cited

U.S. PATENT DOCUMENTS

| | | | | |
|---|---|---|---|---|
| 7,580,012 | B2 * | 8/2009 | Kim et al. | 345/76 |
| 2006/0061560 | A1 * | 3/2006 | Yamashita et al. | 345/204 |
| 2006/0125738 | A1 * | 6/2006 | Kim et al. | 345/76 |
| 2006/0139255 | A1 * | 6/2006 | Kim et al. | 345/76 |
| 2006/0170628 | A1 * | 8/2006 | Yamashita et al. | 345/76 |
| 2006/0244688 | A1 * | 11/2006 | Ahn et al. | 345/76 |
| 2006/0267885 | A1 * | 11/2006 | Kwak et al. | 345/76 |
| 2007/0103406 | A1 * | 5/2007 | Kim | 345/76 |
| 2007/0126671 | A1 * | 6/2007 | Naoaki | 345/77 |
| 2008/0036704 | A1 * | 2/2008 | Kim et al. | 345/76 |

FOREIGN PATENT DOCUMENTS

| | | |
|---|---|---|
| JP | 2005-258326 A | 9/2005 |
| JP | 2006-215213 | 8/2006 |
| JP | 2006-259374 A | 9/2006 |

OTHER PUBLICATIONS

Japanese Office Action issued Jan. 5, 2012 for corresponding Japanese Application No. 2007-038863.

* cited by examiner

*Primary Examiner* — Lun-Yi Lao
*Assistant Examiner* — Gene W Lee
(74) *Attorney, Agent, or Firm* — Rader Fishman & Grauer, PLLC

(57) ABSTRACT

Disclosed herein is a display device including: a pixel array unit having pixel circuits arranged in a form of a matrix; and a control unit having a writing scanning unit for outputting, to the sampling transistor, a writing scanning pulse. The control unit effects control to supply a control input terminal of the drive transistor with a fixed potential for a threshold value correcting operation for retaining a voltage corresponding to a threshold voltage of the drive transistor in the storage capacitor. When setting a voltage across the storage capacitor to the threshold voltage of the drive transistor by repeating the threshold value correcting operation a plurality of times on a time division basis, the control unit effects control to perform each the threshold value correcting operation and the sampling transistor to a conducting state.

9 Claims, 8 Drawing Sheets

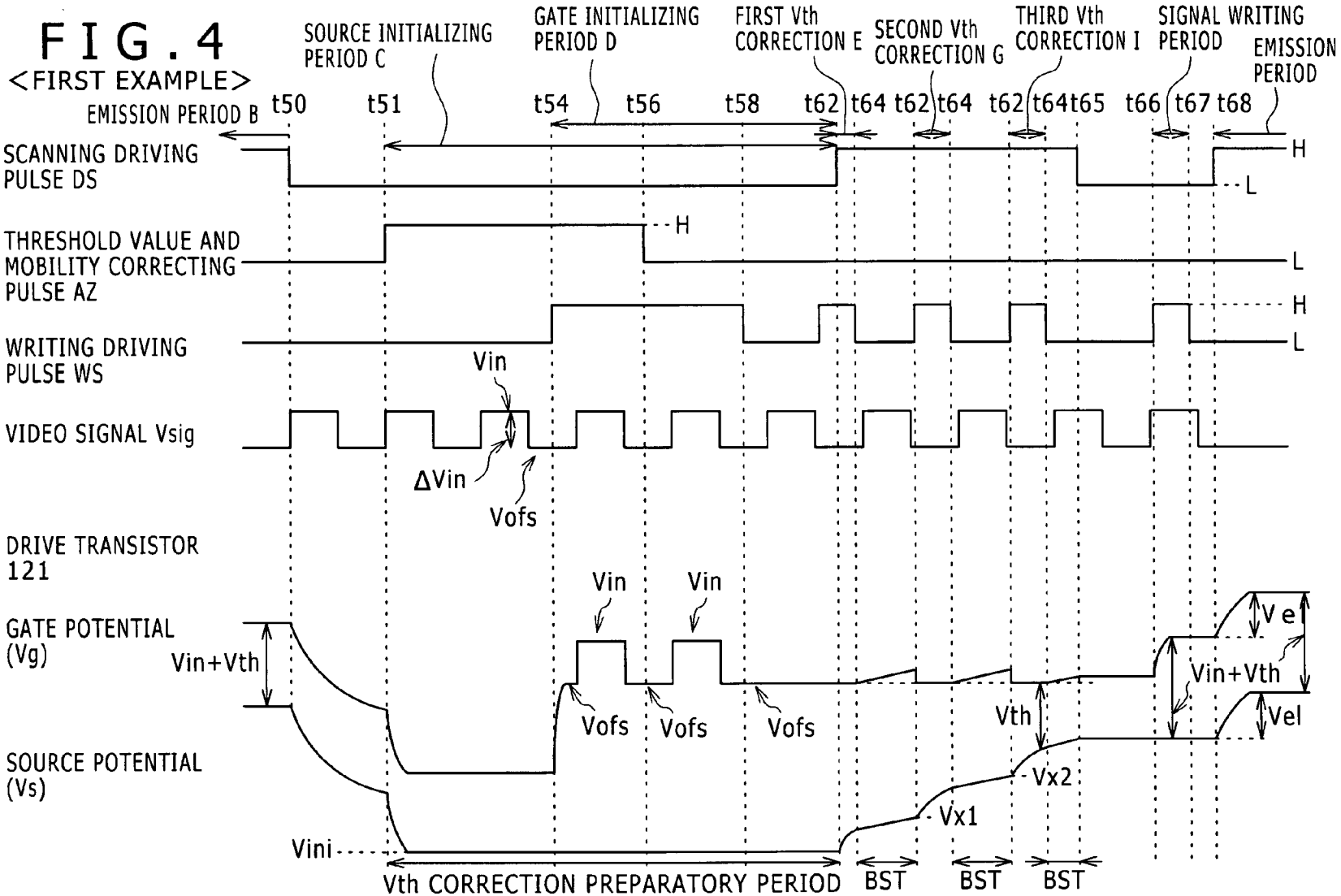
FIG. 4
<FIRST EXAMPLE>
EMISSION PERIOD B
SCANNING DRIVING PULSE DS
THRESHOLD VALUE AND MOBILITY CORRECTING PULSE AZ
WRITING DRIVING PULSE WS
VIDEO SIGNAL Vsig
DRIVE TRANSISTOR 121
GATE POTENTIAL (Vg)
SOURCE POTENTIAL (Vs)
SOURCE INITIALIZING PERIOD C
GATE INITIALIZING PERIOD D
FIRST Vth CORRECTION E
SECOND Vth CORRECTION G
THIRD Vth CORRECTION I
SIGNAL WRITING PERIOD
EMISSION PERIOD
t50
t51
t54
t56
t58
t62
t64
t62
t64
t62
t65
t66
t67
t68
H
L
H
L
H
L
Vin
ΔVin
Vofs
Vin
Vofs
Vin
Vofs
Vofs
Vin+Vth
Vel
Vel
Vth
Vx2
Vx1
BST
BST
BST
Vth CORRECTION PREPARATORY PERIOD
Vini
Vin+Vth

<FIRST EXAMPLE>

DISPLAY DEVICE AND DRIVING METHOD THEREOF

CROSS REFERENCES TO RELATED APPLICATIONS

The present invention contains subject matter related to Japanese Patent Application JP 2007-038863 filed with the Japan Patent Office on Feb. 20, 2007, the entire contents of which being incorporated herein by reference.

BACKGROUND OF THE INVENTION

1. Field of the Invention

The present invention relates to a display device having a pixel array unit in which pixel circuits (referred to also as pixels) including an electrooptic element (referred to also as a display element or a light emitting element) are arranged in the form of a matrix, and a driving method of the display device, and particularly to an active matrix type display device that is formed by arranging pixel circuits having an electrooptic element changing in luminance according to the magnitude of a driving signal as a display element in the form of a matrix and which has an active element in each pixel circuit, display driving being performed in a pixel unit by the active element, and a driving method of the active matrix type display device.

2. Description of the Related Art

There are display devices that use an electrooptic element changing in luminance according to a voltage applied to the electrooptic element or a current flowing through the electrooptic element as a display element of a pixel. For example, a liquid crystal display element is a typical example of an electrooptic element that changes in luminance according to a voltage applied to the electrooptic element, and an organic electroluminescence (hereinafter described as organic EL) element (organic light emitting diode (OLED)) is a typical example of an electrooptic element that changes in luminance according to a current flowing through the electrooptic element. An organic EL display device using the latter organic EL element is a so-called emissive display device using a self-luminous electrooptic element as a display element of a pixel.

The organic EL element is an electrooptic element using a phenomenon of light emission on application of an electric field to an organic thin film. The organic EL element can be driven by a relatively low application voltage (for example 10 V or lower), and thus consumes low power. In addition, the organic EL element is a self-luminous element that emits light by itself, and therefore obviates a need for an auxiliary illuminating member such as a backlight needed in a liquid crystal display device. Thus the organic EL element can be easily reduced in weight and thickness. Further, the organic EL element has a very high response speed (for example a few μs or so), so that no afterimage occurs at a time of displaying a moving image. Because the organic EL element has these advantages, flat-panel emissive display devices using the organic EL element as an electrooptic element have recently been actively developed.

Recently, the development of an active matrix system, which controls a pixel signal supplied to a light emitting element within a pixel by using an active element, for example an insulated gate field effect transistor (generally a thin film transistor (TFT)) similarly provided within the pixel as a switching transistor, has been actively underway.

In this case, in making an electrooptic element within a pixel circuit emit light, the switching transistor takes an input image signal supplied via a video signal line in a storage capacitor (referred to also as a pixel capacitance) provided at the gate terminal (control input terminal) of a drive transistor, and supplies a driving signal corresponding to the taken input image signal to the electrooptic element.

In the organic EL display device using the organic EL element as electrooptic element, because the organic EL element is a current-driven type element, the drive transistor converts the driving signal (voltage signal) corresponding to the input image signal taken in the storage capacitor into a current signal, and supplies the driving current to the organic EL element.

In a current-driven type electrooptic element typified by the organic EL element, a different driving current value means a different light emission luminance. Hence, for light emission at stable luminance, it is important to supply stable driving current to the electrooptic element. For example, driving systems for supplying driving current to the organic EL element can be roughly classified into constant-current driving systems and constant-voltage driving systems (the systems are well known techniques, and therefore publicly known documents thereof will not be presented).

Because the voltage-current characteristic of the organic EL element has a steep slope, when constant-voltage driving is performed, slight variations in voltage or variations in element characteristic cause great variations in current and thus bring about great variations in luminance. Hence, constant-current driving, in which a drive transistor is used in a saturation region, is generally used. Of course, even with constant-current driving, changes in current invite variations in luminance. However, small variations in current cause only small variations in luminance.

Conversely, even with the constant-current driving system, in order for the light emission luminance of an electrooptic element to be unchanged, it is important for a driving signal written to a storage capacitor according to an input image signal and retained by the storage capacitor to be constant. For example, in order for the light emission luminance of an organic EL element to be unchanged, it is important for a driving signal corresponding to an input image signal to be constant.

However, the threshold voltage and mobility of an active element (drive transistor) driving the electrooptic element vary due to process variations. In addition, the characteristics of the electrooptic element such as the organic EL element or the like vary with time. Variations in the characteristics of the active element for such driving and variations in the characteristics of the electrooptic element affect light emission luminance even in the case of the constant-current driving system.

Thus, various mechanisms for correcting luminance variations caused by variations in the characteristics of the active element for the above-described driving and the electrooptic element within each pixel circuit are being studied to uniformly control the light emission luminance over the entire screen of a display device.

For example, a mechanism described in Japanese Patent Laid-Open No. 2006-215213 (referred to as Patent Document 1 hereinafter) as a pixel circuit for an organic EL element has a threshold value correcting function for holding the driving current constant even when there is a variation or a secular change in threshold voltage of the drive transistor, a mobility correcting function for holding the driving current constant even when there is a variation or a secular change in mobility of the drive transistor, and a bootstrap function for holding the driving current constant even when there is a secular change in current-voltage characteristic of the organic EL element.

SUMMARY OF THE INVENTION

However, the mechanism described in Patent Document 1 may require wiring for supplying a potential for correction, a switching transistor for correction, and a switching pulse for driving the switching transistor, and employs a 5TR driving configuration that uses five transistors including a drive transistor and a sampling transistor. Therefore the configuration of the pixel circuit is complex. Many constituent elements of the pixel circuit hinders the achievement of higher definition of the display device. It is consequently difficult to apply the 5TR driving configuration to display devices used in small electronic devices such as portable devices (mobile devices) and the like.

There is thus a desire to develop a system for suppressing luminance changes due to variations in the characteristics of the elements while simplifying the pixel circuit. In developing the system, consideration is to be given to the prevention of occurrence of a new problem attendant on the simplification which problem has not occurred in the 5TR driving configuration.

The present invention has been made in view of the above-described situation. It is desirable to provide a display device in which pixel circuits are simplified for higher definition of the display device and a driving method of the display device.

In addition, it is particularly desirable to provide a mechanism that can ease effects of an operation of driving a pixel circuit on image quality (suppress luminance variations in particular) while simplifying the pixel circuit.

Further, it is desirable to provide a mechanism that can suppress changes in luminance due to variations in the characteristics of a drive transistor and a light emitting element in simplifying the pixel circuit.

An embodiment of a display device according to the present invention is a display device making an electrooptic element within a pixel circuit emit light on a basis of a video signal, the display device including, within pixel circuits arranged in the form of a matrix in a pixel array unit, at least a drive transistor for generating a driving current, an electrooptic element connected to an output terminal of the drive transistor, a storage capacitor for retaining information (driving potential) corresponding to a signal potential of the video signal, and a sampling transistor for writing the information corresponding to the signal potential of the video signal to the storage capacitor. In this pixel circuit, the electrooptic element is made to emit light by generating the driving current based on the information retained in the storage capacitor by the drive transistor and passing the driving current through the electrooptic element.

The information corresponding to the signal potential is written as driving potential to the storage capacitor by the sampling transistor. Thus, the sampling transistor takes in the signal potential at an input terminal (one of a source terminal and a drain terminal) of the sampling transistor, and writes the information corresponding to the signal potential to the storage capacitor connected to an output terminal (the other of the source terminal and the drain terminal) of the sampling transistor. Of course, the output terminal of the sampling transistor is also connected to the control input terminal of the drive transistor.

It is to be noted that the connection configuration of the pixel circuit shown above is a most basic configuration, and that it suffices for the pixel circuit to include at least the above-described constituent elements and the pixel circuit may include other than these constituent elements (that is, other constituent elements). In addition, "connection" is not limited to direct connection, and may be connection via another constituent element.

For example, a change may be made as occasions demand such that a switching transistor, a functional unit having a certain function, or the like is further interposed between connections. Typically, a switching transistor (light emission controlling transistor) for dynamically controlling a display period (an emission period in other words) may be disposed between the output terminal of the drive transistor and the electrooptic element or between the power supply terminal (drain terminal in a typical example) of the drive transistor and a power supply line as wiring for power supply. Of the configurations, an embodiment of the display device according to the present invention at least has, as a basic characteristic, the configuration in which the light emission controlling transistor is disposed between the power supply terminal (drain terminal in a typical example) of the drive transistor and the power supply line as wiring for power supply.

In addition, a peripheral part for driving the pixel circuit P has for example a control unit including a writing scanning unit for performing line-sequential scanning of the pixel circuits by sequentially controlling sampling transistors, and writing information corresponding to a signal potential of a video signal to each of storage capacitors in one row, and a driving scanning unit for outputting a scanning driving pulse for controlling supply of power applied to a power supply terminal of each of drive transistors in one row according to the line-sequential scanning of the writing scanning unit. In addition, the control unit has a horizontal driving unit for performing control to supply a video signal switching between a reference potential and a signal potential within each horizontal period to the sampling transistors according to the line-sequential scanning of the writing scanning unit.

Further, the control unit at least effects control to perform a threshold value correcting operation for retaining a voltage corresponding to the threshold voltage of the drive transistor in the storage capacitor by performing control to supply a fixed potential for the threshold value correcting operation to the control input terminal of the drive transistor in a time period in which a voltage (a so-called power supply voltage) corresponding to a first potential used to pass the driving current is supplied to the power supply terminal of the drive transistor via the light emission controlling transistor. A correcting scanning unit for the control is provided as occasions demand. Preferably, the fixed potential for the threshold value correcting operation is output as video signal in a part of a horizontal scanning period. Thus the sampling transistor can be made to function as a switch transistor for supplying the fixed potential.

The control unit effects control to perform mobility correcting operation for adding an amount of correction for mobility of the drive transistor to the information written to the storage capacitor. A correcting scanning unit for the control is provided as occasions demand.

A correcting scanning unit is preferably used as both the correcting scanning unit for the mobility correcting operation and the correcting scanning unit for the threshold value correcting operation. Accordingly, in the pixel circuit, the light emission controlling transistor is made to function as a correcting switch transistor operating in response to a pulse from the correcting scanning unit for the mobility correcting operation and the threshold value correcting operation.

It is desirable to perform the threshold value correcting operation repeatedly in a plurality of horizontal periods as occasions demand prior to the writing of a signal potential to the storage capacitor. In this case, "as occasions demand"

refers to a case where a voltage corresponding to the threshold voltage of the drive transistor may not be fully retained in the storage capacitor in a threshold value correcting period within one horizontal period. The voltage corresponding to the threshold voltage of the drive transistor is surely retained in the storage capacitor by performing the threshold value correcting operation a plurality of times.

In addition, prior to the threshold value correcting operation, the control unit effects control to perform a preparatory operation for the threshold value correction in which operation initialization is performed so that a potential difference between the control input terminal and the output terminal of the drive transistor is the threshold voltage or higher. More specifically, the storage capacitor is connected between the control input terminal and the output terminal, and a setting is made such that a potential difference across the storage capacitor is the threshold voltage or higher. It is desirable to provide a switch transistor in the pixel circuit for the preparatory operation.

After the threshold value correcting operation, the control unit effects control so as to add an amount of correction for the mobility of the drive transistor to a signal written to the storage capacitor while writing the information of the signal potential to the storage capacitor by making the sampling transistor conduct in a time period in which the signal potential is supplied to the sampling transistor.

The control unit effects control to stop the supply of the video signal to the control input terminal of the drive transistor by setting the sampling transistor in a non-conducting state at a point in time at which the information corresponding to the signal potential is written to the storage capacitor, and perform a bootstrap operation in which the potential of the control input terminal of the drive transistor is interlocked with change in potential of the output terminal of the drive transistor.

The control unit preferably performs the bootstrap operation in an initial stage of a start of light emission, in particular, after an end of sampling operation. Specifically, the potential difference between the control input terminal and the output terminal of the drive transistor is held constant by setting the sampling transistor in a non-conducting state after setting the sampling transistor in a conducting state with the signal potential supplied to the sampling transistor.

In addition, the control unit preferably controls the bootstrap operation so as to achieve an operation of correcting secular changes of the electrooptic element in an emission period. Thus, it is desirable that the control unit continuously hold the sampling transistor in the non-conducting state during the period during which the driving current based on the information retained in the storage capacitor flows through the electrooptic element, whereby the voltage between the control input terminal and the output terminal can be held constant and thus the operation of correcting the secular changes of the electrooptic element is achieved.

In this case, as a characteristic point of an embodiment of the display device according to the present invention, the control unit effects control to supply the fixed potential (for example Vini in FIG. 4) for the threshold value correcting operation to the control input terminal of the drive transistor, and when setting the voltage across the storage capacitor to the threshold voltage of the drive transistor by repeating the threshold value correcting operation a plurality of times on a time division basis, the control unit effects control to perform each threshold value correcting operation by changing the light emission controlling transistor and the sampling transistor to a conducting state in such a manner as to be interlocked with each other in periods in which the fixed potential is supplied during a period of the plurality of threshold value correcting operations. The light emission controlling transistor and the sampling transistor are both set in a non-conducting state in periods in which the video signal is at the signal potential during the period of the plurality of threshold value correcting operations. "To be interlocked with each other" is not limited to simultaneous turning on or off of both the light emission controlling transistor and the sampling transistor, but the light emission controlling transistor and the sampling transistor may be turned on or off in respective timings that are somewhat close to each other.

According to an embodiment of the present invention, when the threshold value correcting operation is repeated a plurality of times on a time division basis, during the period of the plurality of threshold value correcting operations, the light emission controlling transistor and the sampling transistor are held in the conducting state in periods of the fixed potential for threshold value correction, while the light emission controlling transistor and the sampling transistor are held in the non-conducting state in periods in which the video signal is at the signal potential, in such a manner that the light emission controlling transistor and the sampling transistor are interlocked with each other. It is thus possible to avoid a situation such for example as a failure of threshold value correction as a result of bootstrap operation performed during intervals between a plurality of threshold value correcting periods.

BRIEF DESCRIPTION OF THE DRAWINGS

FIG. 4 is a timing chart of assistance in explaining operation of a comparison example in the pixel circuit according to the present embodiment;

DETAILED DESCRIPTION OF THE PREFERRED EMBODIMENTS

Preferred embodiments of the present invention will hereinafter be described in detail with reference to the drawings.

<General Outline of Display Device>

Figure 1:
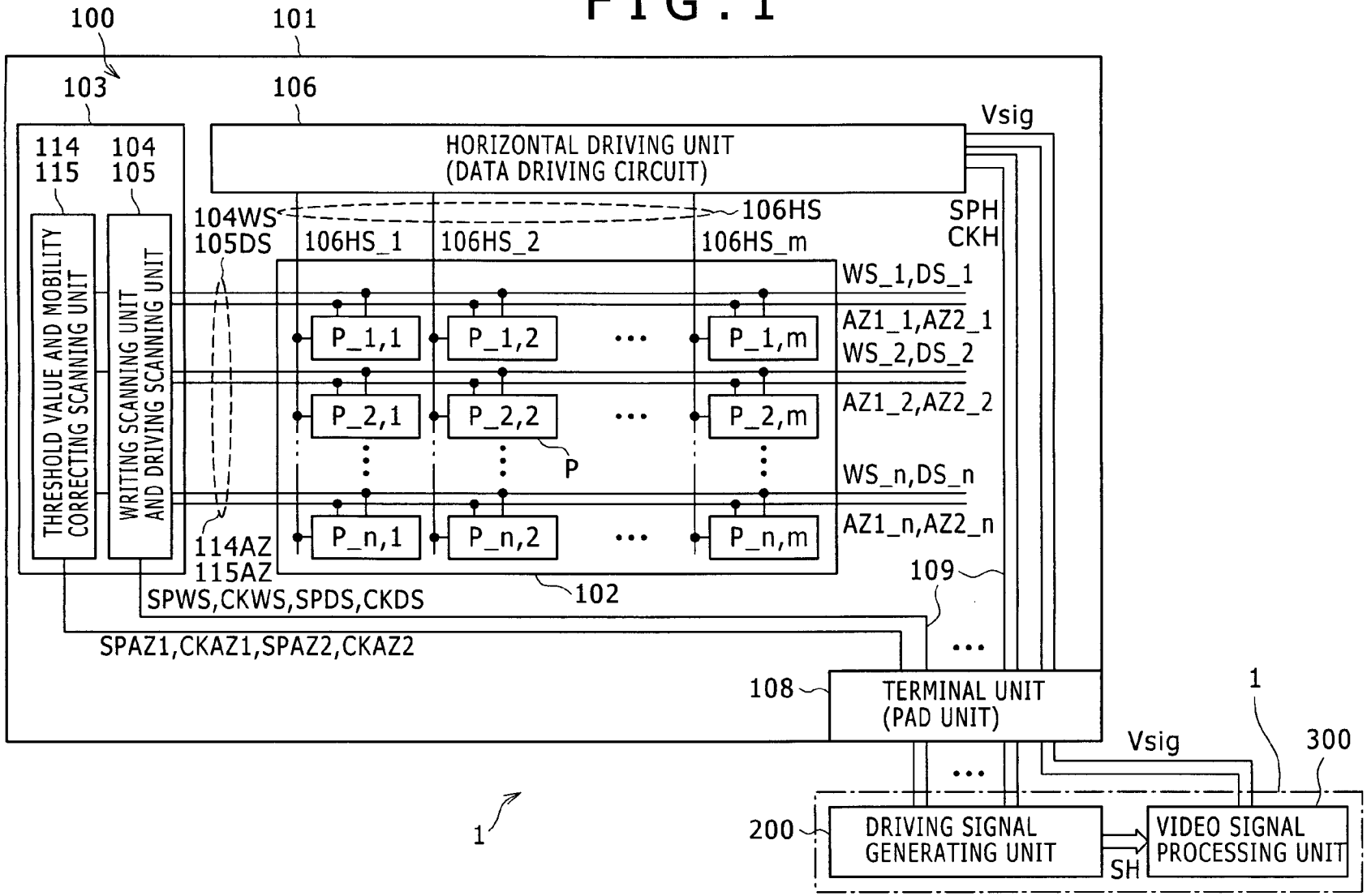
FIG. 1 is a block diagram schematically showing a configuration of an active matrix type display device as an embodiment of a display device according to the present invention.

FIG. 1 is a block diagram schematically showing a configuration of an active matrix type display device as an embodiment of a display device according to the present invention. In the present embodiment, description will be made by taking as an example a case where the present invention is applied to an active matrix type organic EL display (hereinafter referred to as an organic EL display device) that for example uses an organic EL element as a display element of a pixel and a polysilicon thin film transistor (TFT) as an active element and which display is constituted with the organic EL element formed on a semiconductor substrate where the thin film transistor is formed.

Incidentally, while concrete description will be made in the following by taking the organic EL element as the display element of the pixel as an example, the organic EL element is an example, and the intended display element is not limited to the organic EL element. All embodiments to be described later are similarly applicable to all light emitting elements that generally emit light by being driven by current.

As shown in FIG. 1, the organic EL display device 1 includes: a display panel unit 100 in which pixel circuits (referred to also as pixels) 110 having organic EL elements (not shown) as a plurality of display elements are arranged so as to form an effective video area having an aspect ratio of X:Y (for example 9:16) as a display aspect ratio; a driving signal generating unit 200 as an example of a panel controlling unit for generating various pulse signals for driving and controlling the display panel unit 100; and a video signal processing unit 300. The driving signal generating unit 200 and the video signal processing unit 300 are included in a one-chip IC (Integrated Circuit).

A product form in which the organic EL display device 1 is provided is not limited to the form of a module (composite part) having all of the display panel unit 100, the driving signal generating unit 200, and the video signal processing unit 300 as shown in FIG. 1. For example, only the display panel unit 100 can be provided as the organic EL display device 1. Such an organic EL display device 1 is used as a display unit in portable type music players using recording media such as semiconductor memories, minidisks (MD), cassette tapes and the like and other electronic devices.

The display panel unit 100 includes for example a pixel array unit 102 in which pixel circuits P are arranged in the form of a matrix of n rows×m columns, a vertical driving unit 103 for scanning the pixel circuits P in a vertical direction, a horizontal driving unit (referred to also as a horizontal selector or a data line driving unit) 106 for scanning the pixel circuits P in a horizontal direction, and a terminal unit (pad unit) 108 for external connection, wherein the pixel array unit 102, the vertical driving unit 103, the horizontal driving unit 106, and the terminal unit (pad unit) 108 are formed in an integrated manner on a substrate 101. That is, peripheral driving circuits such as the vertical driving unit 103, the horizontal driving unit 106 and the like are formed on the same substrate 101 as the pixel array unit 102.

The vertical driving unit 103 includes for example a writing scanning unit (write scanner WS; Write Scan) 104, a driving scanning unit (drive scanner DS; Drive Scan) 105 (the two units are shown integrally with each other in FIG. 1), and a threshold value & mobility correcting scanning unit 115.

The pixel array unit 102 is for example driven by the writing scanning unit 104, the driving scanning unit 105, and the threshold value & mobility correcting scanning unit 115 from one side or both sides in the horizontal direction in FIG. 1, and is driven by the horizontal driving unit 106 from one side or both sides in the vertical direction in FIG. 1.

The terminal unit 108 is supplied with various pulse signals from the driving signal generating unit 200 disposed outside the organic EL display device 1. The terminal unit 108 is similarly supplied with a video signal Vsig from the video signal processing unit 300.

For example, necessary pulse signals such as shift start pulses SPDS and SPWS as an example of writing start pulses in the vertical direction and vertical scanning clocks CKDS and CKWS are supplied as pulse signals for vertical driving. In addition, necessary pulse signals such as a shift start pulse SPAZ as an example of a threshold value detection start pulse in the vertical direction and a vertical scanning clock CKAZ are supplied as pulse signals for correcting a threshold value and mobility. Further, necessary pulse signals such as a horizontal start pulse SPH as an example of a writing start pulse in the horizontal direction and a horizontal scanning clock CKH are supplied as pulse signals for horizontal driving.

Each terminal of the terminal unit 108 is connected to the vertical driving unit 103 or the horizontal driving unit 106 via wiring 109. For example, pulses supplied to the terminal unit 108 are internally adjusted in voltage level in a level shifter unit not shown in the figure as occasions demand, and then supplied to respective parts of the vertical driving unit 103 or the horizontal driving unit 106 via a buffer.

The pixel array unit 102 has a constitution in which pixel circuits P each having a pixel transistor provided for an organic EL element as a display element, though not shown in the figure (details will be described later), are two-dimensionally arranged in the form of a matrix, a scanning line is disposed for each row of the pixel arrangement, and a signal line is disposed for each column of the pixel arrangement.

For example, scanning lines (gate lines) 104WS and 105DS, a threshold value & mobility correcting scanning line 115AZ, and a signal line (data line) 106HS are formed in the pixel array unit 102. An organic EL element and a thin film transistor (TFT) for driving the organic EL element, which are not shown in FIG. 1, are formed at a part where the scanning line and the signal line intersect each other. A combination of the organic EL element and the thin film transistor forms a pixel circuit P.

Specifically, writing scanning lines 104WS_1 to 104WS_n for the n rows driven by a writing driving pulse WS by the writing scanning unit 104 and driving scanning lines 105DS_1 to 105DS_n for the n rows driven by a scanning driving pulse DS by the driving scanning unit 105 as well as threshold value & mobility correcting scanning lines 115AZ_1 to 115AZ_n for the n rows driven by a threshold value & mobility correcting pulse AZ by the threshold value & mobility correcting scanning unit 115 are disposed for each pixel row of the pixel circuits P arranged in the form of a matrix.

The writing scanning unit 104 and the driving scanning unit 105 sequentially select each pixel circuit P via each scanning line 105DS and 104WS on the basis of the pulse signals for a vertical driving system which pulse signals are supplied from the driving signal generating unit 200. The horizontal driving unit 106 writes an image signal to selected pixel circuits P via the signal line 106HS on the basis of the pulse signals for a horizontal driving system which pulse signals are supplied from the driving signal generating unit 200.

Line-sequential driving is performed in which each part of the vertical driving unit 103 scans the pixel array unit 102 on a line-sequential basis and in synchronism with the scanning, the horizontal driving unit 106 simultaneously writes image signals for one horizontal line to the pixel array unit 102. When a provision is made for the line-sequential driving, the horizontal driving unit 106 includes a driver circuit for simultaneously turning on switches not shown in the figure which switches are provided on the signal lines 106HS of all the columns. The horizontal driving unit 106 simultaneously turns on the switches not shown in the figure which switches are provided on the signal lines 106HS of all the columns to simultaneously write pixel signals output from the video signal processing unit 300 to all the pixel circuits P of one line of the row selected by the vertical driving unit 103.

Each part of the vertical driving unit 103 is formed by a combination of logic gates (including latches), and selects the pixel circuits P of the pixel array unit 102 in row units. Incidentally, while FIG. 1 shows a configuration in which the vertical driving unit 103 is disposed on one side of the pixel array unit 102, the vertical driving unit 103 can be arranged on both a left side and a right side with the pixel array unit 102 interposed between the left side and the right side. Similarly, while FIG. 1 shows a configuration in which the horizontal driving unit 106 is disposed on one side of the pixel array unit 102, the horizontal driving unit 106 can be arranged on both an upper side and a lower side with the pixel array unit 102 interposed between the upper side and the lower side.

<Pixel Circuit>

Figure 2:
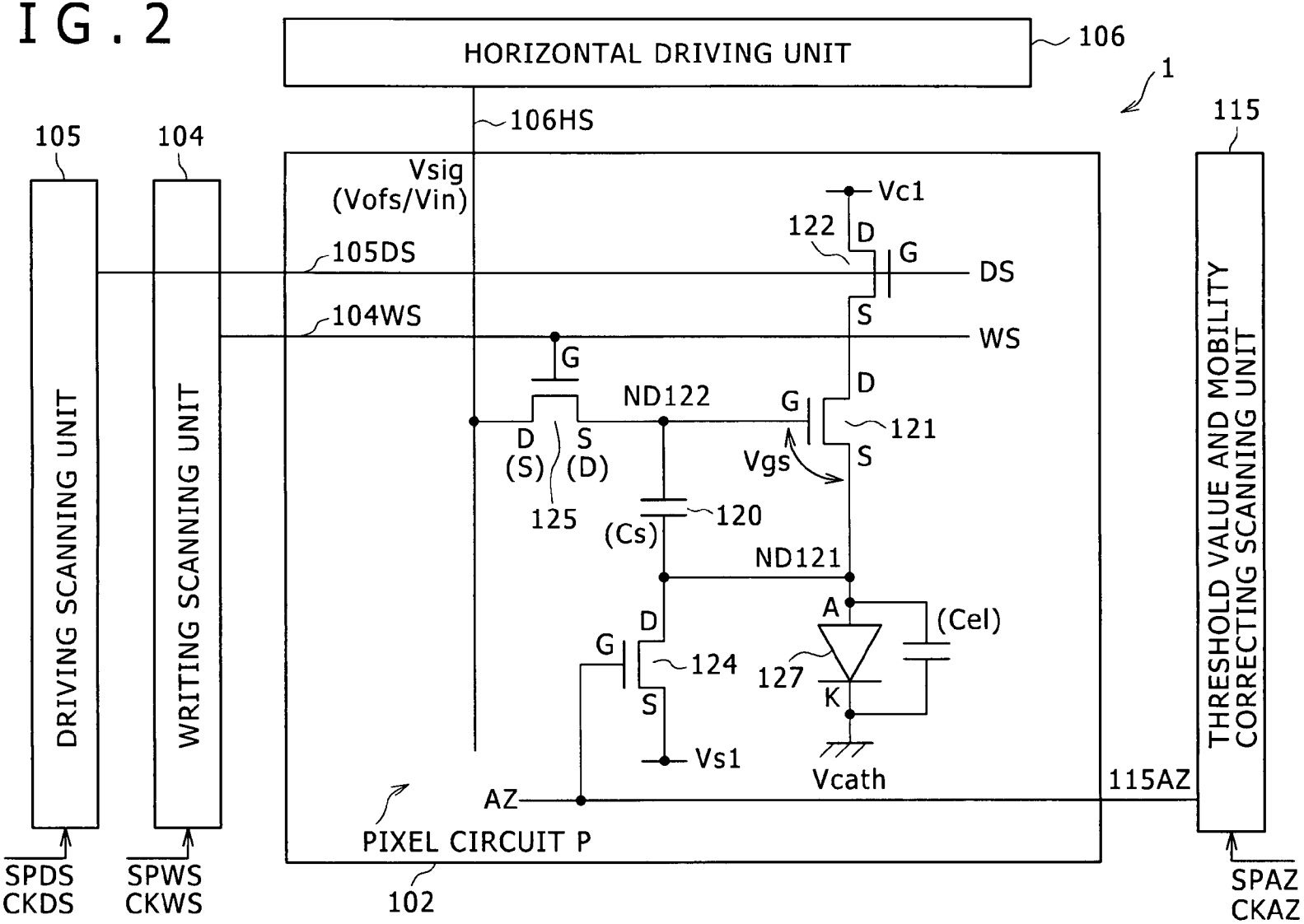
FIG. 2 is a diagram showing an example of a pixel circuit according to the present embodiment.
Figure 3A:
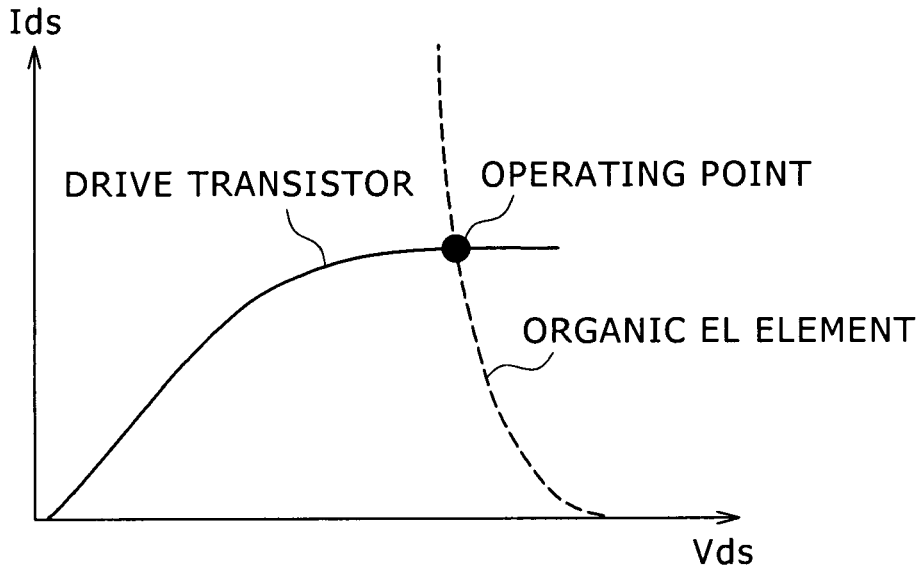
FIG. 3A is a diagram of assistance in explaining an operating point of an organic EL element and a drive transistor and FIGS. 3B to 3D are diagrams of assistance in explaining effects of characteristic variations of the organic EL element and the drive transistor on driving current Ids.

FIG. 2 is a diagram showing an example of a pixel circuit P according to the present embodiment forming the organic EL display device 1 shown in FIG. 1. Incidentally, FIG. 2 also shows the vertical driving unit 103 and the horizontal driving unit 106 provided in the peripheral part on the periphery of the pixel circuits P on the substrate 101 of the display panel unit 100. FIG. 3 is a diagram of assistance in explaining an operating point of the organic EL element and the drive transistor. FIG. 3A is a diagram of assistance in explaining effects of characteristic variations of the organic EL element and the drive transistor on driving current Ids.

The pixel circuit P according to the present embodiment has a characteristic in that a drive transistor is basically formed by an n-channel type thin film field effect transistor. The pixel circuit P has another characteristic in that the pixel circuit P has a circuit for suppressing variations in the driving current Ids supplied to the organic EL element due to secular degradation of the organic EL element, that is, a driving signal uniformizing circuit (1) for correcting changes in current-voltage characteristics of the organic EL element as an example of an electrooptic element and achieving a threshold value correcting function and a mobility correcting function for maintaining the driving current Ids at a constant level. In addition, the pixel circuit P has a characteristic in that the pixel circuit P has a driving signal uniformizing circuit (2) for achieving a bootstrap operation for making the driving current constant even when there is a secular change in the current-voltage characteristics of the organic EL element.

When all the switch transistors can be formed by n-channel type transistors rather than p-channel type transistors, an amorphous silicon (a-Si) process in the related art can be used in the fabrication of the transistors. Thereby the cost of a transistor substrate can be reduced, and development of the pixel circuit P having such a constitution is anticipated.

A MOS transistor is used as each of the transistors including the drive transistor. In this case, the gate terminal of the drive transistor is treated as a control input terminal, one of the source terminal and the drain terminal (the source terminal in this case) of the drive transistor is treated as an output terminal, and the other is treated as a power supply terminal (the drain terminal in this case).

The pixel circuit P according to the present embodiment includes: a storage capacitor (referred to also as a pixel capacitance) 120; an n-channel type drive transistor 121; an n-channel type light emission controlling transistor 122 whose gate terminal G as a control input terminal is supplied with an active-H driving pulse (scanning driving pulse DS); an n-channel type sampling transistor 125 whose gate terminal G as a control input terminal is supplied with an active-H driving pulse (writing driving pulse WS); and an organic EL element 127 as an example of an electrooptic element (light emitting element) that emits light while a current flows through the element.

The sampling transistor 125 is a switching transistor provided on the side of the gate terminal G (control input terminal) of the drive transistor 121. The light emission controlling transistor 122 is also a switching transistor.

Generally, the organic EL element 127 has a current rectifying property and is thus represented by the symbol of a diode. Incidentally, the organic EL element 127 has a parasitic capacitance (equivalent capacitance) Cel. FIG. 2 shows the parasitic capacitance Cel in parallel with the organic EL element 127.

The pixel circuit P according to the present embodiment has a characteristic in that the light emission controlling transistor 122 is disposed on the side of the drain terminal D of the drive transistor 121, in that a bootstrap circuit is formed by connecting the storage capacitor 120 between the gate and the source of the drive transistor 121, and in that the pixel circuit P has a switch transistor forming a threshold value & mobility correcting circuit.

Because the organic EL element 127 is a current light emitting element, a color gradation is obtained by controlling an amount of current flowing through the organic EL element 127. Thus, the value of the current flowing through the organic EL element 127 is controlled by changing a voltage applied to the gate terminal G of the drive transistor 121. At this time, the bootstrap circuit and the threshold value & mobility correcting circuit eliminate effects of a secular change of the organic EL element 127 and characteristic variations of the drive transistor 121. Thus, the vertical driving unit 103 for driving the pixel circuits P includes the threshold value & mobility correcting scanning unit 115 in addition to the writing scanning unit 104 and the driving scanning unit 105.

While FIG. 2 shows one pixel circuit P, pixel circuits P having a similar configuration are arranged in the form of a matrix, as described with reference to FIG. 1. The writing scanning lines 104WS_1 to 104WS_n for the n rows driven by the writing driving pulse WS by the writing scanning unit 104 and the driving scanning lines 105DS_1 to 105DS_n for the n rows driven by the scanning driving pulse DS by the driving scanning unit 105 as well as the threshold value & mobility correcting scanning lines 115AZ_1 to 115AZ_n for the n rows driven by the threshold value & mobility correcting pulse AZ by the threshold value & mobility correcting scanning unit 115 are disposed for each pixel row of the pixel circuits P arranged in the form of a matrix.

The bootstrap circuit includes an n-channel type detecting transistor 124 connected in parallel with the organic EL element 127 and supplied with the active-H threshold value & mobility correcting pulse AZ, and is formed by the detecting transistor 124 and the storage capacitor 120 connected between the gate and the source of the drive transistor 121. The storage capacitor 120 also functions as a bootstrap capacitance.

The threshold value & mobility correcting circuit includes the n-channel type detecting transistor 124 supplied with the active-H threshold value & mobility correcting pulse AZ between the gate terminal G of the drive transistor 121 and a second power supply potential Vc2, and is formed by the detecting transistor 124, the drive transistor 121, the light emission controlling transistor 122, and the storage capacitor 120 connected between the gate and the source of the drive transistor 121. The storage capacitor 120 also functions as a threshold voltage retaining capacitance retaining a detected threshold voltage Vth.

The drive transistor 121 has a drain terminal D connected to the source terminal S of the light emission controlling transistor 122. The drain terminal D of the light emission controlling transistor 122 is connected to a first power supply potential Vc1. The gate terminal G of the light emission controlling transistor 122 is supplied with the active-H scanning driving pulse DS from the driving scanning unit 105 via the driving scanning line 105DS.

In the present embodiment, in consideration for low power consumption, letting Vgs_122 be the gate-to-source voltage of the light emission controlling transistor 122, Vth_122 be the threshold voltage of the light emission controlling transistor 122, and Vds_122 be the drain-to-source voltage of the light emission controlling transistor 122, the light emission controlling transistor 122 is operated in a linear region (Vgs_122−Vth_122>Vds_122) at least for an emission period of the organic EL element 127. Thus, the driving scanning unit 105 sets the amplitude (a difference between an L level and an H level) of the scanning driving pulse DS smaller so that the light emission controlling transistor 122 is not saturated while turned on at least during the emission period of the organic EL element 127.

The source terminal S of the drive transistor 121 is directly connected to the anode terminal A of the organic EL element 127. A point of connection between the source terminal S of the drive transistor 121 and the anode terminal A of the organic EL element 127 is set as a node ND121. The cathode terminal K of the organic EL element 127 is connected to grounding wiring Vcath (GND) common to all pixels which wiring supplies a reference potential, and is thus supplied with a cathode potential Vcath.

The sampling transistor 125 has a gate terminal G connected to the writing scanning line 104WS from the writing scanning unit 104, a drain terminal D connected to a video signal line 106HS, and a source terminal S connected to the gate terminal G of the drive transistor 121. A point of connection between the source terminal S of the sampling transistor 125 and the gate terminal G of the drive transistor 121 is set as a node ND122. The gate terminal G of the sampling transistor 125 is supplied with the active-H writing driving pulse WS from the writing scanning unit 104. The sampling transistor 125 can also be in a mode of connection in which the source terminal S and the drain terminal D are reversed. The storage capacitor 120 has one terminal connected to the source terminal S of the drive transistor 121, and another terminal connected to the gate terminal G of the same drive transistor 121.

The detecting transistor 124 is a switching transistor. The detecting transistor 124 has a drain terminal D connected to the node ND121 as the point of connection between the source terminal S of the drive transistor 121 and the anode terminal A of the organic EL element 127, a source terminal S connected to a reference potential Vini (referred to also as a ground potential Vs1) as an example of a reference potential, and a gate terminal G as a control input terminal connected to the threshold value & mobility correcting scanning line 115AZ. By connecting the storage capacitor 120 between the gate and the source of the drive transistor 121 and turning on the detecting transistor 124, the potential of the source terminal S of the drive transistor 121 is connected to the reference potential Vini as a fixed potential via the detecting transistor 124.

The sampling transistor 125 operates when selected by the writing scanning line 104WS. The sampling transistor 125 samples a pixel signal Vsig (the signal potential Vin of the pixel signal Vsig) from the signal line 106HS, and retains a voltage having a magnitude corresponding to the signal potential Vin in the storage capacitor 120 via the node ND122. The potential retained by the storage capacitor 120 is ideally of the same magnitude as the signal potential Vin, but is actually lower than the signal potential Vin.

When the light emission controlling transistor 122 is on under the scanning driving pulse DS, the drive transistor 121 drives the organic EL element 127 by current according to the driving potential retained by the storage capacitor 120 (the gate-to-source voltage Vgs of the drive transistor 121 at this time). The light emission controlling transistor 122 conducts when selected by the driving scanning line 105DS so as to supply current from the first power supply potential Vc1 to the drive transistor 121.

Thus, by connecting the side of the drain terminal D as the power supply terminal of the drive transistor 121 to the first power supply potential Vc1 via the light emission controlling transistor 122, and controlling the on period of the light emission controlling transistor 122, it is possible to adjust the emission period and the non-emission period of the organic EL element 127, and thereby perform duty driving.

The detecting transistor 124 operates when set in a selected state by supplying the active-H threshold value & mobility correcting pulse AZ from the threshold value & mobility correcting scanning unit 115 to the threshold value & mobility correcting scanning line 115AZ. The detecting transistor 124 performs a predetermined correcting operation (an operation of correcting variations in threshold voltage Vth and mobility μ in this case). For example, in order to detect the threshold voltage Vth of the drive transistor 121 prior to the current driving of the organic EL element 127 and cancel the effect of the threshold voltage Vth in advance, the detecting transistor 124 retains a detected potential in the storage capacitor 120.

In addition, a preparatory operation prior to the threshold value correction can be performed using an offset voltage Vofs (referred to also as a reference potential Vo) as a constant potential (a fixed potential) of the video signal Vsig in the video signal line 106HS and the reference potential Vini on the source terminal S side of the detecting transistor 124. This preparatory operation initializes the potentials of the control input terminal (gate terminal G) and the output terminal (source terminal S) of the drive transistor 121 such that a potential difference between the two terminals (gate-to-source voltage Vgs) is equal to or greater than the threshold voltage Vth. Incidentally, the offset voltage Vofs is used for the initializing operation prior to the threshold value correcting operation, and is also used to precharge the video signal line 106HS.

As a condition for ensuring normal operation of the pixel circuit P, the reference potential Vini is set lower than a level obtained by subtracting the threshold voltage Vth of the drive transistor 121 from the offset voltage Vofs of the video signal Vsig. That is, "Vini<Vofs−Vth". In other words, "Vofs−Vini>Vth" is satisfied, and the reference potential Vini is set as a potential sufficiently lower than the offset voltage Vofs of the video signal Vsig in the video signal line 106HS.

In addition, a level obtained by adding a threshold voltage VthEL of the organic EL element 127 to the potential Vcath of the cathode terminal K of the organic EL element 127 is set higher than the reference potential Vini. That is, "Vcath+VthEL>Vini". This means a condition in which the organic EL element 127 is reverse-biased during the preparatory operation prior to the threshold value correcting operation. The cathode potential Vcath may be considered to be 0 V (=ground potential), so that "VthEL>Vini".

In addition, the potential of the anode (the source potential Vs of the drive transistor 121) in a threshold value correcting period is set higher than the level obtained by adding the threshold voltage VthEL of the organic EL element 127 to the potential Vcath of the cathode terminal K of the organic EL element 127. That is, "Vofs−Vth<Vcath+VthEL". This means a condition in which the organic EL element 127 is reverse-biased also during the threshold value correcting period. The cathode potential Vcath may be considered to be 0 V (=ground potential), so that "Vofs−Vth<VthEL".

In the pixel circuit P in the comparison example having such a constitution, the sampling transistor 125 conducts in response to the writing driving pulse WS supplied from the writing scanning line 104WS during a predetermined signal writing period (sampling period) so as to sample the video signal Vsig supplied from the video signal line 106HS in the storage capacitor 120. The storage capacitor 120 applies an input voltage (gate-to-source voltage Vgs) between the gate and the source of the drive transistor 121 according to the sampled video signal Vsig.

The drive transistor 121 supplies an output current corresponding to the gate-to-source voltage Vgs as driving current Ids to the organic EL element 127 during a predetermined emission period. When the organic EL element 127 is driven, the drain terminal D of the drive transistor 121 is supplied with a first potential Vcc_H, and the source terminal S of the drive transistor 121 is connected to the anode terminal A side of the organic EL element 127, whereby a source follower circuit is formed as a whole.

Incidentally, the driving current Ids has dependence on the carrier mobility μ of a channel region in the drive transistor 121 and the threshold voltage Vth of the drive transistor 121. The organic EL element 127 emits light at a luminance corresponding to the video signal Vsig (the signal potential Vin in particular) on the basis of the driving current Ids supplied from the drive transistor 121.

The pixel circuit P according to the present embodiment has a correcting section formed by switching transistors (the light emission controlling transistor 122 and the detecting transistor 124). In order to cancel the dependence of the driving current Ids on the carrier mobility μ, the gate-to-source voltage Vgs retained by the storage capacitor 120 is corrected in advance at a start of an emission period.

Specifically, the correcting section (the switching transistors 122 and 124) operates in a part (for example a second half side) of a signal writing period according to the writing driving pulse WS and the scanning driving pulse DS supplied from the writing scanning line 104WS and the driving scanning line 105DS so as to correct the gate-to-source voltage Vgs by extracting the driving current Ids from the drive transistor 121 in a state of the video signal Vsig being sampled and negatively feeding back the driving current Ids to the storage capacitor 120. Further, in order to cancel the dependence of the driving current Ids on the threshold voltage Vth, the correcting section (the switching transistors 122 and 124) detects the threshold voltage Vth of the drive transistor 121 in advance prior to the signal writing period, and adds the detected threshold voltage Vth to the gate-to-source voltage Vgs.

In particular, in the pixel circuit P according to the present embodiment, the drive transistor 121 is an n-channel type transistor and has the drain thereof connected to the positive power side, while the source of the drive transistor 121 is connected to the organic EL element 127 side. In this case, the above-described correcting section extracts the driving current Ids from the drive transistor 121 and negatively feeds back the driving current Ids to the storage capacitor 120 side in a start part of an emission period overlapping a later part of the signal writing period. At this time, the correcting section allows the driving current Ids extracted from the source terminal S side of the drive transistor 121 in the start part of the emission period to flow into the parasitic capacitance Cel of the organic EL element 127. Specifically, the organic EL element 127 is a diode type light emitting element having an anode terminal A and a cathode terminal K. The anode terminal A side is connected to the source terminal S of the drive transistor 121, while the cathode terminal K side is connected to the grounding side (the cathode potential Vcath in the present example).

With this constitution, the correcting section (the switching transistors 122 and 124) sets a reverse-biased state between the anode and the cathode of the organic EL element 127 in advance, and thus makes the diode type organic EL element 127 function as a capacitive element when the driving current Ids extracted from the source terminal S side of the drive transistor 121 flows into the organic EL element 127.

Incidentally, the correcting section can adjust a duration t during which the driving current Ids is extracted from the drive transistor 121 within the signal writing period. The correcting section thereby optimizes an amount of negative feedback of the driving current Ids to the storage capacitor 120. In this case, "optimizing the amount of negative feedback" means that mobility correction can be performed properly at any level in a range from a black level to a white level of video signal potential. The amount of negative feedback applied to the gate-to-source voltage Vgs is dependent on the extraction time of the driving current Ids. The longer the extraction time, the larger the amount of negative feedback.

For example, by providing a slope to a rising edge of the voltage of the signal line 106HS as a video line signal potential or a transition characteristic of the writing driving pulse WS of the writing scanning line 104WS, the mobility correcting period t is made to follow the video line signal potential automatically, and is thus optimized. That is, the mobility correcting period t can be determined by a phase difference between the writing scanning line 104WS and the signal line 106HS, and can also be determined by the potential of the signal line 106HS. A mobility correcting parameter ΔV is ΔV=Ids·Cel/t. As is clear from this equation, the higher the driving current Ids as the drain-to-source current of the drive transistor 121, the higher the mobility correcting parameter ΔV. Conversely, when the driving current Ids of the drive transistor 121 is low, the mobility correcting parameter ΔV is low. Thus, the mobility correcting parameter ΔV is determined according to the driving current Ids.

At this time, the mobility correcting period t does not necessarily have to be constant, and it may be rather desirable to adjust the mobility correcting period t according to the driving current Ids. For example, it is desirable to set the mobility correcting period t shorter when the driving current Ids is high, and conversely set the mobility correcting period t longer when the driving current Ids is decreased. Accordingly, by providing a slope to a rising edge of the video signal line potential (the potential of the signal line 106HS) or the transition characteristic of the writing driving pulse WS of the writing scanning line 104WS, automatic adjustment is performed such that the correcting period t is shortened when the potential of the signal line 106HS is high (when the driving current Ids is high) and the correcting period t is lengthened when the potential of the signal line 106HS is low (when the driving current Ids is low). Thus, an appropriate correcting period can be set automatically in such a manner as to follow the video signal potential (the signal potential Vin of the video signal Vsig). An optimum mobility correction can therefore be made irrespective of the luminance or the pattern of an image.

The pixel circuit P according to the present embodiment shown in FIG. 2 employs a 4TR constitution in which on the basis of the constitution of 2TR driving using one switching transistor (sampling transistor 125) for scanning for the video signal Vsig in addition to the drive transistor 121, the light emission controlling transistor 122 for dynamically controlling a display period (or an emission period) is provided on the drain terminal D side of the drive transistor 121, and one switching transistor (the sampling transistor 124) is used for scanning for correcting the threshold value and mobility. In addition, the pixel circuit P has a characteristic in that the pixel circuit P prevents effects of secular degradation of the organic EL element 127 and changes in characteristics of the drive transistor 121 (for example variations and changes in threshold voltage, mobility and the like) from being produced on the driving current Ids by setting on/off timing of the writing driving pulse WS, the scanning driving pulse DS, and the threshold value & mobility correcting pulse AZ for controlling the respective switching transistors.

In addition, the pixel circuit P according to the present embodiment shown in FIG. 2 has a characteristic in a mode of connection of the storage capacitor 120. The storage capacitor 120 forms the bootstrap circuit, which is an example of the driving signal uniformizing circuit (2), as a circuit for preventing a change in driving current due to the secular degradation of the organic EL element 127. The pixel circuit P has a characteristic in that the pixel circuit P has the driving signal uniformizing circuit (2) for achieving a bootstrap function for making the driving current constant (preventing variations in the driving current) even when there is a secular change in the current-voltage characteristic of the organic EL element. Specifically, in the pixel circuit P according to the present embodiment, the storage capacitor 120 is connected between the gate terminal G (node ND122) and the source terminal S of the drive transistor 121, and the source terminal S of the drive transistor 121 is directly connected to the anode terminal A of the organic EL element 127.

<Basic Operation>

First, a case where the light emission controlling transistor 122 and the detecting transistor 124 are not provided, and the storage capacitor 120 has one terminal connected to the node ND122 and the other terminal connected to the grounding wiring Vcath (GND) common to all pixels will be described as a comparison example for describing features of the pixel circuit P according to the present embodiment shown in FIG. 2. Such a pixel circuit P will hereinafter be referred to as a pixel circuit P of the comparison example.

In the pixel circuit P of the comparison example, the potential of the source terminal S (source potential Vs) of the drive transistor 121 is determined by the operating point of the drive transistor 121 and the organic EL element 127, and the voltage value differs depending on the gate potential Vg of the drive transistor 121.

Generally, as shown in FIG. 3A, the drive transistor 121 is driven in a saturation region. Thus, letting Ids be the current flowing between the drain terminal and the source of the transistor operating in the saturation region, μ be mobility, W be a channel width (gate width), L be a channel length (gate length), Cox be a gate capacitance (gate oxide film capacitance per unit area), and Vth be the threshold voltage of the transistor, the drive transistor 121 is a constant-current source having a value as expressed by the following Equation (1). Incidentally, "^" denotes a power. As is clear from Equation (1), the drain current Ids of the transistor is controlled by the gate-to-source voltage Vgs, and the drive transistor 121 operates as a constant-current source.

$$Ids = \frac{1}{2}\mu\frac{W}{L}Cox(Vgs - Vth)\hat{}2 \quad (1)$$

<Iel-Vel Characteristics and I-V Characteristics of Light Emitting Element>

Figure 3B:
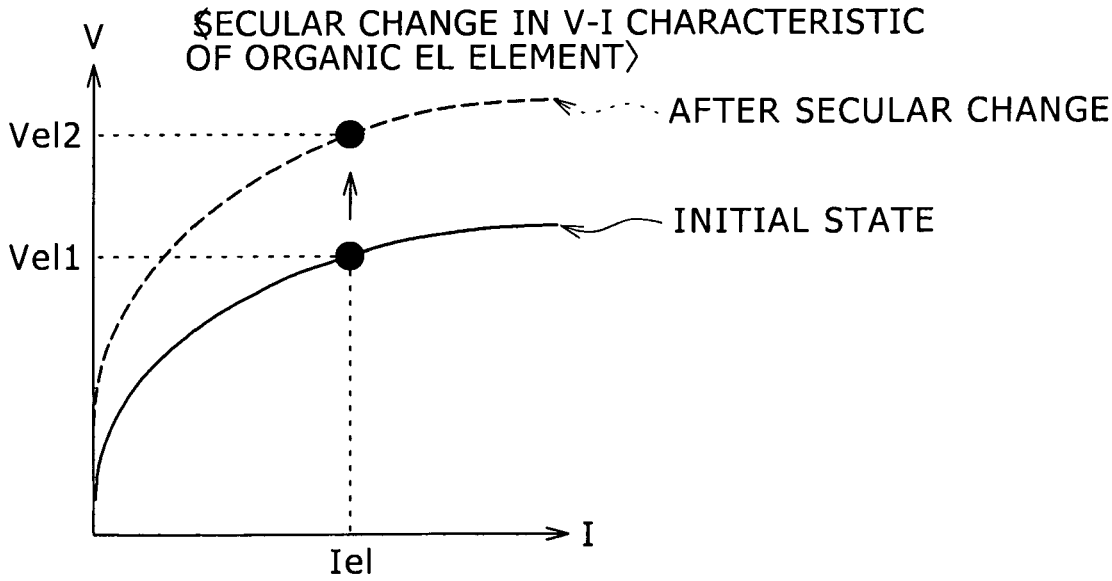

In current-voltage (Iel-Vel) characteristics of a current-driven type light emitting element typified by an organic EL element which characteristics are shown in FIG. 3B, a curve shown as a solid line indicates a characteristic at a time of an initial state, and a curve shown as a broken line indicates a characteristic after a secular change. In general, the I-V characteristic of a current-driven type light emitting element including an organic EL element is degraded with the passage of time as shown in the graph.

For example, when a light emission current Iel flows through the organic EL element 127 as an example of a light emitting element, the anode-to-cathode voltage Vel of the organic EL element 127 is determined uniquely. As shown in FIG. 3B, during an emission period, the light emission current Iel determined by the drain-to-source current Ids (=driving current Ids) of the drive transistor 121 flows through the anode terminal A of the organic EL element 127, and the anode terminal A of the organic EL element 127 thereby rises by the anode-to-cathode voltage Vel.

In the pixel circuit P of the comparison example, the anode-to-cathode voltage Vel for the same light emission current Iel is changed from Vel1 to Vel2 as a result of a secular change in the I-V characteristic of the organic EL element 127. Therefore the operating point of the drive transistor 121 is changed. Even when a same gate potential Vg is applied, the source potential Vs of the drive transistor 121 is changed. As a result, the gate-to-source voltage Vgs of the drive transistor 121 is changed.

In the simple circuit using an n-channel type as the drive transistor 121, the source terminal S of the drive transistor 121 is connected to the organic EL element 127 side, and therefore the simple circuit is affected by a secular change in the I-V characteristic of the organic EL element 127. An amount of current (light emission current Iel) flowing through the organic EL element 127 is thus changed. As a result, light emission luminance is changed.

Specifically, in the pixel circuit P of the comparison example, the operating point is changed due to a secular change in the I-V characteristic of the organic EL element 127. Even when a same gate potential Vg is applied, the source potential Vs of the drive transistor 121 is changed. Thus, the gate-to-source voltage Vgs of the drive transistor 121 is changed. As is clear from the characteristic equation (1), a variation in the gate-to-source voltage Vgs varies the driving current Ids even when the gate potential Vg is constant, and at the same time changes the value of the current flowing through the organic EL element 127. Thus, in the pixel circuit P of the comparison example, a change in the I-V characteristic of the organic EL element 127 leads to a secular change in the light emission luminance of the organic EL element 127.

In the simple circuit using an n-channel type as the drive transistor 121, the source terminal S of the drive transistor 121 is connected to the organic EL element 127 side, and therefore the gate-to-source voltage Vgs is changed with a secular change of the organic EL element 127. The amount of current flowing through the organic EL element 127 is thus changed. As a result, light emission luminance is changed.

A variation in the anode potential of the organic EL element 127 due to a secular change in the characteristic of the organic EL element 127 as an example of a light emitting element appears as a variation in the gate-to-source voltage Vgs of the drive transistor 121, and causes a variation in drain current (driving current Ids). The variation in the driving current from this cause appears as a variation in light emission luminance of each pixel circuit P, thus causing degradation in picture quality.

On the other hand, as will be described later in detail, by setting the sampling transistor 125 in a non-conducting state at a time when information corresponding to a signal potential Vin has been written to the storage capacitor 120 (and continuously holding the sampling transistor 125 in the non-conducting state during a subsequent emission period of the organic EL element 127), a bootstrap operation is performed in which a circuit configuration and driving timing are set to achieve a bootstrap function that makes the potential Vg of the gate terminal G interlocked with variation in the source potential Vs of the drive transistor 121.

Thereby, even when there is a variation in anode potential of the organic EL element 127 (that is, a variation in source potential) due to a secular change in the characteristic of the organic EL element 127, the gate potential Vg is varied so as to cancel the variation. Thus the uniformity of screen luminance can be secured. The bootstrap function can improve the capability of correcting a secular variation of a current-driven type light emitting element typified by an organic EL element.

This bootstrap function can be started at a time of a start of light emission at which time the writing driving pulse WS is changed to an inactive-L state and thus the sampling transistor 125 is turned off, and the bootstrap function also functions when the source potential Vs of the drive transistor 121 is thereafter changed with change in the anode-to-cathode voltage Vel in a process in which the light emission current Iel starts to flow through the organic EL element 127 and the anode-to-cathode voltage Vel rises with the start of the flow of the light emission current Iel until the anode-to-cathode voltage Vel stabilizes.

<Vgs-Ids Characteristic of Drive Transistor>

In addition, due to variations in a process of manufacturing the drive transistor 121, each pixel circuit P has characteristic variations in threshold voltage, mobility, and the like. Even when the drive transistor 121 is driven in a saturation region and a same gate potential is supplied to the drive transistor 121, the characteristic variations change the drain current (driving current Ids) in each pixel circuit P, which change appears as non-uniformity of light emission luminance.

Figure 3C:
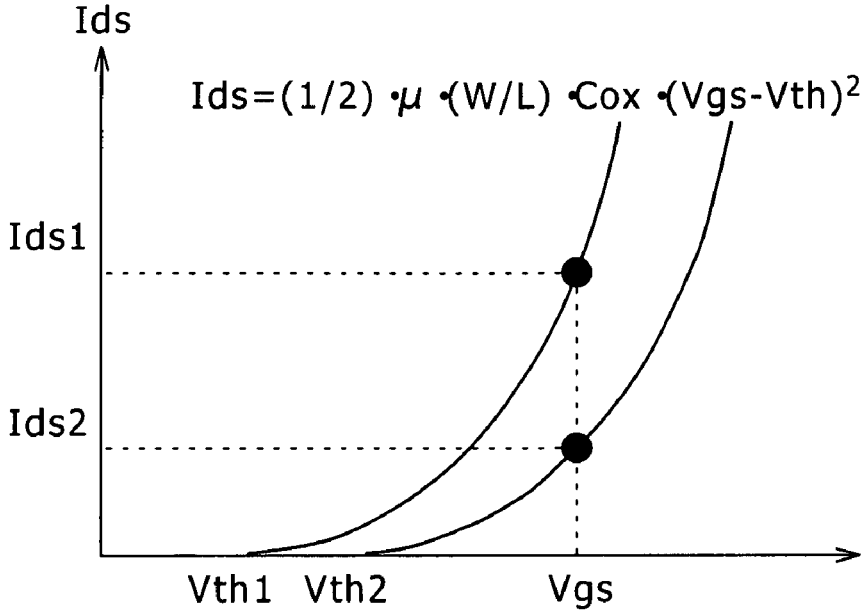

For example, FIG. 3C is a diagram showing a voltage-current (Vgs-Ids) characteristic with attention directed to variations in threshold value of the drive transistor 121. Respective characteristic curves are cited with respect to two drive transistors 121 having different threshold voltages of Vth1 and Vth2.

As described above, the drain current Ids when the drive transistor 121 operates in a saturation region is expressed by the characteristic equation (1). As is clear from the characteristic equation (1), when the threshold voltage Vth varies, the drain current Ids varies even if the gate-to-source voltage Vgs is constant. That is, when no measure is taken against variations in the threshold voltage Vth, as shown in FIG. 3C, a driving current corresponding to a voltage Vgs when the threshold voltage is Vth1 is Ids1, whereas a driving current Ids2 corresponding to the same gate voltage Vgs when the threshold voltage is Vth2 differs from Ids1.

Figure 3D:
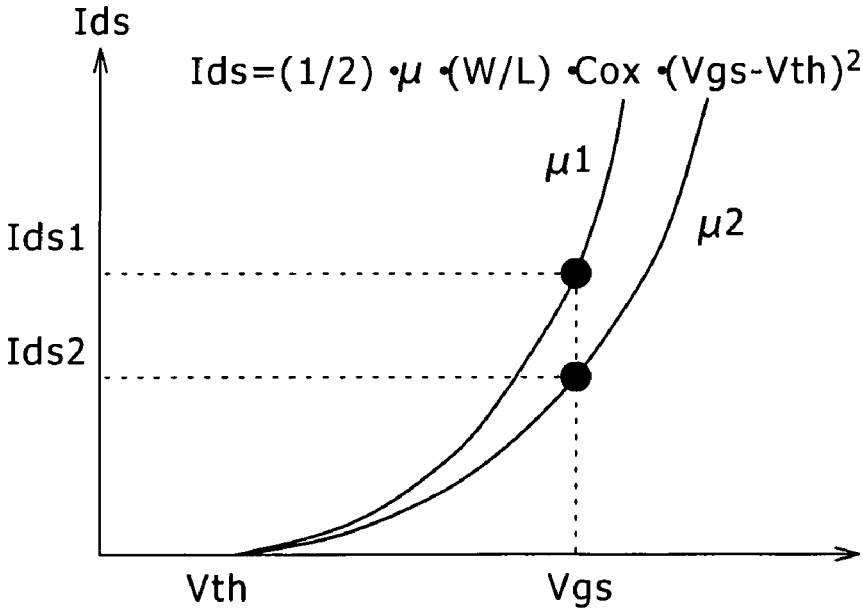

Further, FIG. 3D is a diagram showing a voltage-current (Vgs-Ids) characteristic with attention directed to variations in mobility of the drive transistor 121. Respective characteristic curves are cited with respect to two drive transistors 121 having different mobilities of μ1 and μ2.

As is clear from the characteristic equation (1), when the mobility μ varies, the drain current Ids varies even if the gate-to-source voltage Vgs is constant. That is, when no measure is taken against variations in the mobility μ, as shown in FIG. 3D, a driving current corresponding to a voltage Vgs when the mobility is μ1 is Ids1, whereas a driving current corresponding to the same gate voltage Vgs when the mobility is μ2 is Ids2, which differs from Ids1.

As shown in FIG. 3C or FIG. 3D, if a great difference occurs in Vin-Ids characteristic due to a difference in threshold voltage Vth or mobility μ, the driving current Ids, that is, light emission luminance becomes different even when a same signal potential Vin is given. Therefore the uniformity of screen luminance may not be obtained. On the other hand, by setting driving timing for achieving a threshold value correcting function and a mobility correcting function (details will be described later), it is possible to suppress effects of these variations, and thus secure the uniformity of screen luminance.

In a threshold value correcting operation and a mobility correcting operation according to the present embodiment, though details will be described later, the gate-to-source voltage Vgs at a time of light emission is expressed as "Vin+Vth−ΔV". The drain-to-source current Ids is thereby prevented from being dependent on variations or changes in threshold voltage Vth and from being dependent on variations or changes in mobility μ. As a result, even when the threshold voltage Vth and the mobility μ are varied in a manufacturing process or with the passage of time, the driving current Ids does not vary, and thus the light emission luminance of the organic EL element 127 does not vary.

<Operation of Pixel Circuit of Present Embodiment>

Driving timing for the pixel circuit P according to the present embodiment will first be described from a qualitative viewpoint. As driving timing in the pixel circuit P according to the present embodiment, the sampling transistor 125 first conducts in response to a writing driving pulse WS supplied from the writing scanning line 104WS to sample a video signal Vsig supplied from the video signal line 106HS and retain information corresponding to a signal potential Vin as a potential in an effective period of the video signal Vsig as a driving potential in the storage capacitor 120. The same is true for a case of driving an ordinary pixel circuit.

The drive transistor 121 is supplied with a current from the power supply potential Vc1, and sends a driving current Ids through the organic EL element 127 according to the driving potential retained in the storage capacitor 120 (the potential corresponding to the potential in the effective period of the video signal Vsig: the potential corresponding to the signal potential Vin).

The vertical driving unit 103 sets the writing driving pulse WS as a control signal for making the sampling transistor 125 conduct in an active-H state during a time period during which the video signal line 106HS is at an offset voltage Vofs (reference potential Vo) in a non-effective period of the video signal Vsig. Thereby a voltage corresponding to the threshold voltage Vth of the drive transistor 121 is retained in the storage capacitor 120. This operation realizes a threshold value correcting function. This threshold value correcting function can cancel effect of the threshold voltage Vth of the drive transistor 121 which threshold voltage Vth is varied in each pixel circuit P.

Preferably, the vertical driving unit 103 repeats the threshold value correcting operation in a plurality of horizontal periods prior to the sampling of the signal potential Vin of the video signal Vsig to surely retain the voltage corresponding to the threshold voltage Vth of the drive transistor 121 in the storage capacitor 120. A sufficiently long writing time is secured by thus performing the threshold value correcting operation a plurality of times. Thereby the voltage corresponding to the threshold voltage Vth of the drive transistor 121 can be surely retained in the storage capacitor 120 in advance. Such a threshold value correction will be referred to as "divided threshold value correction".

The retained voltage corresponding to the threshold voltage Vth is used to cancel the threshold voltage Vth of the drive transistor 121. Thus, even when the threshold voltage Vth of the drive transistor 121 is varied in each pixel circuit P, the threshold voltage Vth of the drive transistor 121 is cancelled completely, so that the uniformity of an image, that is, the uniformity of light emission luminance over the entire screen of the display device is enhanced. Luminance non-uniformity that tends to appear when the signal potential represents a low gradation, in particular, can be prevented.

Preferably, prior to the threshold value correcting operation, the vertical driving unit 103 sets (initializes) the source potential Vs of the drive transistor 121 to the reference potential Vini by setting the threshold value & mobility correcting pulse AZ active (an H level in the present example) with the scanning driving pulse DS set inactive (an L level in the present example). In addition, the vertical driving unit 103 sets (initializes) the gate potential Vg of the drive transistor 121 to the offset voltage Vofs by setting the writing driving pulse WS active (an H level in the present example) during a period when the video signal Vsig is the offset voltage Vofs. The vertical driving unit 103 thus sets the voltage across the storage capacitor 120 connected between the gate and the source of the drive transistor 121 to a voltage higher than the threshold voltage Vth, and then starts the threshold value correcting operation. Such an operation of resetting (an operation of initializing) the gate potential and the source potential enables the following threshold value correcting operation to be performed surely.

The pixel circuit P according to the present embodiment can have a mobility correcting function in addition to the threshold value correcting function. For example, the vertical driving unit 103 after the threshold value correcting operation performs control so as to write information (driving potential) corresponding to the signal potential Vin to the storage capacitor 120 by making the sampling transistor 125 conduct during a time period when the signal potential Vin is supplied to the sampling transistor 125, then add an amount of correction for the mobility of the drive transistor 121 to the signal written in the storage capacitor by setting the scanning driving pulse DS in an active-H state while the signal potential Vin remains supplied to the gate terminal G of the drive transistor 121, and thereafter set the writing driving pulse WS in an inactive-L state. A period from the setting of the scanning driving pulse DS in the active-H state to the setting of the writing driving pulse WS in the inactive state is a mobility correcting period. By setting this period properly, the amount of correction for the mobility μ of the drive transistor 121 can be adjusted properly.

The pixel circuit P according to the present embodiment also has a bootstrap function by having the storage capacitor 120 connected between the gate and the source of the drive transistor 121. Specifically, the writing scanning unit 104 cancels the application of the writing driving pulse WS to the writing scanning line 104WS (that is, sets the writing driving pulse WS in an inactive-L state) in a stage in which the storage capacitor 120 retains the driving potential corresponding to the signal potential Vin of the video signal Vsig. The writing scanning unit 104 thereby sets the sampling transistor 125 in a non-conducting state to disconnect the gate terminal G of the drive transistor 121 from the video signal line 106HS electrically.

The storage capacitor 120 is connected between the gate terminal G and the source terminal S of the drive transistor 121. Because of an effect of the storage capacitor 120, the gate potential Vg of the drive transistor 121 becomes interlocked with the variation in the source potential Vs of the drive transistor 121. Thus the bootstrap function for holding the gate-to-source voltage Vgs constant can be exerted.

<Timing Chart; Comparison Example>

FIG. 4 is a timing chart of assistance in explaining operation of a comparison example in the pixel circuit P according to the present embodiment. FIG. 4 shows the waveforms of the writing driving pulse WS, the threshold value & mobility correcting pulse AZ, and the scanning driving pulse DS along a time axis t. As is understood from the above description, since the switching transistors 122, 124, and 125 are of an n-channel type, the switching transistors 122, 124, and 125 are on when the respective pulses DS, AZ, and WS are at a high (H) level, and are off when the respective pulses DS, AZ, and WS are at a low (L) level. Incidentally, this timing chart also shows the video signal Vsig, changes in potential at the gate terminal G of the drive transistor 121, and changes in potential at the source terminal S of the drive transistor 121 together with the waveforms of the respective pulses WS, AZ, and DS.

Basically, similar driving is performed for each row of the writing scanning line 104WS and the threshold value & mobility correcting scanning line 115AZ with a delay of one horizontal scanning period. Timings and signals in FIG. 4 are shown as the same timings and signals as timings and signals for a first row irrespective of a row being processed. When a row has to be distinguished in description, timings and signals for the row are distinguished by indicating the row being processed by a reference provided with "_". In addition, in description and figures, when different driving pulses occur in similar timing, for example, DS (in the case of the scanning driving pulse DS), AZ (in the case of the threshold value & mobility correcting pulse AZ), WS (in the case of the writing driving pulse WS), and V (in the case of the video signal Vsig) for distinguishing the respective driving pulses are attached as occasions demand.

In the driving timing of the comparison example, a period during which the video signal Vsig is at the offset voltage Vofs (which voltage is the same in all horizontal periods), which period is a non-effective period (fixed signal period), is set as a first half part of one horizontal period, and a period during which the video signal Vsig is at the signal potential Vin (which potential is different in each horizontal period), which period is an effective period, is set as a second half part of one horizontal period. That is, the video signal Vsig is a pulse assuming the two values of the offset voltage Vofs and the signal potential Vin in a 1 H period.

In addition, in the driving timing of the comparison example, the threshold value correcting operation is performed a plurality of times (for example three times) in each horizontal period as a combination of the effective period and the non-effective period of the video signal Vsig. Timing of switching between the effective period and the non-effective period of the video signal Vsig (t62V and t64V) at each time of threshold value correcting operation and timing of switching between the active state and the inactive state of the scanning driving pulse DS (t62DS and t64DS) are distinguished by indicating each time by a reference without "_".

Incidentally, in the driving timing shown in FIG. 4, the threshold value correcting operation is repeated a plurality of times with one horizontal period as a process cycle. One horizontal period is the process cycle of the threshold value correcting operation because for each row, after going through an initializing operation of setting the gate potential Vg of the drive transistor 121 to the offset voltage Vofs and setting the source potential Vs of the drive transistor 121 to the reference potential Vini prior to the threshold value correcting operation before the sampling transistor 125 samples the signal potential Vin in the storage capacitor 120, the threshold value correcting operation is performed to retain the voltage corresponding to the threshold voltage Vth of the drive transistor 121 in the storage capacitor 120 by turning on the light emission controlling transistor 122 in a time period in which the video signal line 106HS is at the offset voltage Vofs while the sampling transistor 125 remains in a conducting state.

A time period when the video signal line 106HS is at the offset voltage Vofs appears in each horizontal period, is present in the first half part of the video signal Vsig as described above, and is shorter than one horizontal period. Therefore a threshold value correcting period is inevitably shorter than one horizontal period. Hence, there can be a case where an accurate voltage corresponding to the threshold voltage Vth may not be retained in the storage capacitor 120 in this short threshold value correcting period for one threshold value correcting operation because of the capacitance Cs of the storage capacitor 120, a difference between the reference potential Vini and the offset voltage Vofs, and other factors. The threshold value correcting operation is performed a plurality of times in order to deal with this case. That is, by repeating the threshold value correcting operation in a plurality of horizontal periods prior to the sampling (signal writing) of the signal potential Vin in the storage capacitor 120, the voltage corresponding to the threshold voltage Vth of the drive transistor 121 is surely retained in the storage capacitor 120.

As a basic mechanism of the driving timing, threshold value correction and signal writing are performed within one horizontal scanning period. When the number of pixels of a panel is increased for higher definition, or when field frequency is increased for higher picture quality, one horizontal scanning period is shortened, and thus a sufficient threshold value correction may not be made. Conversely, when a certain threshold value correcting period is secured, the signal writing period is squeezed, and thus the video signal Vsig (signal potential Vin) may not be sufficiently written to the storage capacitor 120. As an improvement for dealing with such possibilities, the threshold value correcting operation is performed a plurality of times. A provision is thereby made for higher definition and higher picture quality of the panel.

In the suppressing method of the comparison example, at the time of the threshold value correcting operation performed a plurality of times, the scanning driving pulse DS is continuously set in an active-H state to hold the light emission controlling transistor 122 in an on state. In this state, according to the video signal Vsig that repeats the offset voltage Vofs and the signal potential Vin, the writing driving pulse WS is set in an active-H state to turn on the sampling transistor 125 during the period of the offset voltage Vofs. Thereby the information of the threshold voltage Vth is written to the storage capacitor 120. That is, threshold value correcting periods other than a first threshold value correcting period and a last threshold value correcting period are defined by the on period of the sampling transistor 125 (to be exact, the period during which the sampling transistor 125 is on within the period during which the light emission controlling transistor 122 is on). In defining the threshold value correcting period, the period during which the writing driving pulse WS is in an active-H state (the sampling transistor 125 is on) is dominant (given priority).

Incidentally, the first threshold value correcting period is excluded because a time point of a start of the first threshold value correcting period is defined by a time point when the writing driving pulse WS and the scanning driving pulse DS are both set in an active-H state. In addition, the last threshold value correcting period is excluded because when signal writing is continuously performed during the period of a first signal potential Vin after the last threshold value correcting period, a time point of a start of the last threshold value correcting period is defined by a time point when the writing driving pulse WS is set in an active-H state, while a time point of an end of the last threshold value correcting period is defined by a time point when the scanning driving pulse DS is set in an inactive-L state. When signal writing is not performed during the period of the first signal potential Vin after the last threshold value correcting period, but the signal writing is performed after an interval, a time point of an end of the last threshold value correcting period is defined by a time point when the writing driving pulse WS is set in an inactive-L state, and the last threshold value correcting period is also defined by the on period of the sampling transistor 125 (to be exact, the period during which the sampling transistor 125 is on within the period during which the light emission controlling transistor 122 is on).

Entering a new field in line-sequential scanning, the driving scanning unit 105 first changes the scanning driving pulse DS supplied to the driving scanning line 105DS in the first row from an active-H state to an inactive-L state with the threshold value & mobility correcting pulse AZ and the writing driving pulse WS in an inactive-L state (t50).

Thereby, the light emission controlling transistor 122 is turned off, and thus the drive transistor 121 is disconnected from the power supply potential Vc1. Therefore the light emission of the organic EL element 127 stops and a non-emission period begins. In timing t50, the controlling transistors 122, 124, and 125 are set in an off state. At this time, because the writing driving pulse WS is in the inactive-L state, and thus the sampling transistor 125 is off, the gate terminal G of the drive transistor 121 has a high impedance. Because the storage capacitor 120 is connected between the gate and the source of the drive transistor 121, the source potential Vs and the gate potential Vg are lowered in an interlocked manner so as to retain an immediately preceding gate-to-source voltage Vgs.

Next, while the scanning driving pulse DS and the writing driving pulse WS remain in the inactive-L state, the vertical driving unit 103 changes the threshold value & mobility correcting pulse AZ to an active-H state by the threshold value & mobility correcting scanning unit 115 to turn on the detecting transistor 124 (t51 to t56). Thereby, the reference potential Vini is set as the voltage of the node ND121, that is, the reference potential Vini is set at the other terminal of the storage capacitor 120 and the source terminal S of the drive transistor 121. Thus the source potential Vs is initialized. A period ending at a start of the threshold value correcting operation (t51 to t62DS, t62WS) is an initializing period C for initializing the source potential Vs.

At this time, because the writing driving pulse WS is in the inactive-L state, and thus the sampling transistor 125 is off, the gate terminal G of the drive transistor 121 has a high impedance. Because the storage capacitor 120 is connected between the gate and the source of the drive transistor 121, the gate potential Vg decreases in such a manner as to follow a decrease in the source potential Vs so as to retain the immediately preceding gate-to-source voltage Vgs.

Thereafter, with the scanning driving pulse DS in the inactive-L state and with the threshold value & mobility correcting pulse AZ remaining in the active-H state, the vertical driving unit 103 changes the writing driving pulse WS to an active-H state by the writing scanning unit 104 to turn on the sampling transistor 125 (t54WS). Further, after the threshold value & mobility correcting pulse AZ is set in the inactive-L state, the vertical driving unit 103 changes the writing driving pulse WS to the inactive-L state (t58WS). Thereby, the offset voltage Vofs is set as the voltage of the node ND122, that is, the offset voltage Vofs is set at the gate terminal G of the drive transistor 121. The gate potential Vg is thus initialized. A period ending at a start of the threshold value correcting operation (t54WS to t62DS, t62WS) is an initializing period D for initializing the gate potential Vg. In order to prevent the source potential Vs from being affected by coupling in timing in which the gate potential Vg of the drive transistor 121 becomes equal to the offset voltage Vofs, the detecting transistor 124 driven by the threshold value & mobility correcting pulse AZ is turned on to set the source at the reference potential Vini.

A period during which the writing driving pulse WS is in the active-H state (t54WS to t55WS) is set to include the period of the offset voltage Vofs of the video signal Vsig (t54WS to t55WS). Preferably, the period during which the writing driving pulse WS is in the active-H state includes the period of the offset voltage Vofs of the video signal Vsig a plurality of times (twice in the present example).

In the present example, in a second half part of the period during which the writing driving pulse WS is in the active-H state (t54WS to t55WS), the threshold value & mobility correcting pulse AZ is in the inactive-L state, and therefore a variation when the gate potential Vg makes a transition to the offset voltage Vofs affects the source potential Vs.

Because the offset voltage Vofs and the reference potential Vini are set so as to satisfy "Vofs−Vini>Vth", as described above, the gate-to-source voltage Vgs of the drive transistor 121, that is, the voltage retained by the storage capacitor 120 connected between the gate and the source of the drive transistor 121 is set to a voltage exceeding the threshold voltage Vth of the drive transistor 121, and the storage capacitor 120 is thus reset prior to the threshold value correcting operation. In addition, because a setting is made such that "VthEL>Vini", a reverse bias is applied to the organic EL element 127, so that the subsequent threshold value correcting operation is performed normally.

After completing the preparatory operation for threshold value correction, the vertical driving unit 103 sets the scanning driving pulse DS in the active-H state by the driving scanning unit 105 to turn on the light emission controlling transistor 122 (t62DS1). In addition, in such a manner as to coincide with timing in which the video signal Vsig is at the offset voltage Vofs (t62V1 to t64V1), the vertical driving unit 103 changes the writing driving pulse WS to the active-H state by the writing scanning unit 104 to turn on the sampling transistor 125 (t62WS1).

Thereby a first threshold value correcting period E begins in which the drain current is used to charge or discharge the storage capacitor 120 and the organic EL element 127, and in which information for correcting (cancelling) the threshold voltage Vth of the drive transistor 121 is recorded in the storage capacitor 120. The first threshold value correcting period E continues until timing in which the writing driving pulse WS is set in the inactive-L state (t64WS1).

Preferably, the period during which the writing driving pulse WS is in the active-H state (t62WS to t64WS) is completely included within the time period during which the video signal Vsig is at the offset voltage Vofs (t62V to t64V). Incidentally, the timing t62WS and the timing t62DS may be substantially the same, or may be temporally close to each other. This is because the threshold value correcting period is defined by the period during which the writing driving pulse WS is in the active-H state within the period during which the scanning driving pulse DS is in the active-H state. Of course, in actuality, the threshold value correcting period is defined by a period during which the light emission controlling transistor 122 and the sampling transistor 125 supplied with the respective pulses DS and WS are actually on.

In the present example, the writing driving pulse WS is first changed to the active-H state (t62WS1) such that timing in which the writing driving pulse WS is set in the active-H state is completely included within the time period during which the video signal Vsig is at the offset voltage Vofs (t62V1 to t64V1). Thereafter, the scanning driving pulse DS is changed to the active-H state (t62DS1) within the period during which the writing driving pulse WS is in the active-H state (t62WS1 to t64WS1).

In the first threshold value correcting period E, the gate terminal G of the drive transistor 121 is maintained at the offset voltage Vofs of the video signal Vsig, the source potential Vs of the drive transistor 121 rises, and a drain current flows until the drive transistor 121 cuts off. When the drive transistor 121 cuts off, the source potential Vs of the drive transistor 121 becomes "Vofs−Vth". That is, because an equivalent circuit of the organic EL element 127 is represented by a parallel circuit of a diode and a parasitic capacitance Cel, as long as "Vel≦Vcath+VthEL", that is, as long as a leakage current of the organic EL element 127 is considerably lower than the current flowing through the drive transistor 121, the current of the drive transistor 121 is used to charge or discharge the storage capacitor 120 and the parasitic capacitance Cel.

Consequently, when the drain current flows through the drive transistor 121, a voltage Vel at the anode terminal A of the organic EL element 127, that is, the potential of the node ND121 rises with time. Then, when a potential difference between the potential of the node ND121 (source potential Vs) and the voltage of the node ND122 (gate potential Vg) becomes exactly the threshold voltage Vth, the drive transistor 121 changes from an on state to an off state, and thus the drain current stops flowing. Thereby the threshold value correcting period is ended. That is, after the passage of a certain time, the gate-to-source voltage Vgs of the drive transistor 121 assumes the value of the threshold voltage Vth, and this information is retained by the storage capacitor 120 connected between the gate and the source of the drive transistor 121.

In this case, although the voltage corresponding to the threshold voltage Vth is to be written to the storage capacitor 120 connected between the gate terminal G and the source terminal S of the drive transistor 121, the first threshold value correcting period E is actually a period from the timing of setting the writing driving pulse WS in the active-H state (t62WS1) to the timing of returning the writing driving pulse WS to the inactive-L state (t64WS1), and when this period is not sufficiently secured, the first threshold value correcting period E is ended before the voltage corresponding to the threshold voltage Vth is written to the storage capacitor 120 connected between the gate terminal G and the source terminal S of the drive transistor 121.

Specifically, the first threshold value correcting period E ends when the gate-to-source voltage Vgs becomes Vx1 (>Vth), that is, when the source potential Vs of the drive transistor 121 has changed from the reference potential Vini on a low potential side to "Vofs−Vx1". Thus, Vx1 is written to the storage capacitor 120 at a point in time when the first threshold value correcting period E is completed (t64WS1).

Next, with the scanning driving pulse DS remaining in the active-H state, the writing scanning unit 104 changes the writing driving pulse WS to the inactive-L state to turn off the sampling transistor 125 (t64WS1) before the video signal Vsig becomes the signal potential Vin in the second half part of one horizontal period. Then, the horizontal driving unit 106 changes the potential of the video signal line 106HS from the offset voltage Vofs to the signal potential Vin (t64V1) so that the signal potential is sampled in a pixel of another row. Thereby, while the potential of the writing scanning line 104WS (the writing driving pulse WS) is at a low level, the video signal line 106HS is changed to the signal potential Vin.

As described above, the period t62WS to t64WS during which the writing driving pulse WS is in the active-H state (that is, the period during which the sampling transistor 125 is on) is completely included within the period t62V to t64V during which the video signal Vsig is at the offset voltage Vofs. In other words, a period t64V to t62V during which the video signal Vsig is at the signal potential Vin is completely included within a period during which the sampling transistor 125 is surely off.

In this case, the light emission controlling transistor 122 is in a conducting (on) state during the period t64WS to t62WS during which the sampling transistor 125 is off. In addition, because the voltage corresponding to the threshold voltage Vth is not fully written to the storage capacitor 120 in the first threshold value correcting period E, the gate-to-source voltage Vgs of the drive transistor 121 is higher than the threshold voltage Vth (Vgs>Vth). When the light emission controlling transistor 122 is on in such a state, a drain current flows through the drive transistor 121, and a so-called bootstrap operation (described as BST in FIG. 4) in which the source potential Vs rises and the gate potential Vg also rises is performed. While no problem may occur if the threshold value correcting operation is performed once, there is a fear of an adverse effect of repeating the threshold value correcting operation a plurality of times as in the present example. This will be described later in detail.

In a first half of a next horizontal period (1 H), the horizontal driving unit 106 changes the potential of the video signal line 106HS from the signal potential Vin to the offset voltage Vofs (t62V2), and then the writing scanning unit 104 changes the writing driving pulse WS to the active-H state (t62WS2). Thereby a second threshold value correcting period (referred to as a second threshold value correcting period G) begins in which a drain current flows into the storage capacitor 120 in a state of the gate potential Vg of the drive transistor 121 being the offset voltage Vofs and thus information for correcting (cancelling) the threshold voltage Vth of the drive transistor 121 is recorded in the storage capacitor 120. This second threshold value correcting period G continues until timing in which the writing driving pulse WS is set in the inactive-L state (t64WS2).

In the second threshold value correcting period G, the same operation as in the first threshold value correcting period E is performed. Specifically, the gate terminal G of the drive transistor 121 is maintained at the offset voltage Vofs of the video signal Vsig, and the gate potential Vg is instantly changed from an immediately preceding potential to the offset voltage Vofs. Thereafter, the source potential Vs of the drive transistor 121 rises from the source potential Vs (>Vofs−Vx1) at that point in time, and a drain current flows until the drive transistor 121 cuts off. When the drive transistor 121 cuts off, the source potential Vs of the drive transistor 121 becomes "Vofs−Vth".

However, the second threshold value correcting period G is a period from the timing of setting the writing driving pulse WS in the active-H state (t62WS2) to the timing of returning the writing driving pulse WS to the inactive-L state (t64WS2), and when this period is not sufficiently secured, the second threshold value correcting period G is ended before the voltage corresponding to the threshold voltage Vth is written to the storage capacitor 120 connected between the gate terminal G and the source terminal S of the drive transistor 121. This is the same as in the first threshold value correcting period E. The second threshold value correcting period G ends when the gate-to-source voltage Vgs becomes Vx2 (<Vx1 and >Vth), that is, when the source potential Vs of the drive transistor 121 has changed from "Vo−Vx1" to "Vo−Vx2". Thus, Vx2 is written to the storage capacitor 120 at a point in time when the second threshold value correcting period G is completed (t64WS2).

Similarly, after the writing driving pulse WS is once set in the inactive-L state (t64WS2), a third threshold value correcting period (referred to as a third threshold value correcting period I) begins (t62WS3) in a first half of a next horizontal period (1 H). The third threshold value correcting period I continues until timing in which the writing driving pulse WS is set in the inactive-L state (t64WS3).

In the third threshold value correcting period I, the same operation as in the first threshold value correcting period E and the second threshold value correcting period G is performed. Specifically, the gate terminal G of the drive transistor 121 is maintained at the offset voltage Vofs of the video signal Vsig, and the gate potential is instantly changed from the immediately preceding potential to the offset voltage Vofs. Thereafter, the source potential Vs of the drive transistor 121 rises from the source potential Vs (>Vofs−Vx2) at that point in time, and a drain current flows until the drive transistor 121 cuts off. The drain current is cut off when the gate-to-source voltage Vgs becomes exactly the threshold voltage Vth. When the drain current is cut off, the source potential Vs of the drive transistor 121 becomes "Vofs−Vth".

That is, as a result of a process in a plurality of threshold value correcting periods (three threshold value correcting periods in the present example), the gate-to-source voltage Vgs of the drive transistor 121 assumes the value of the threshold voltage Vth. In this case, in actuality, the voltage corresponding to the threshold voltage Vth is written to the storage capacitor 120 connected between the gate terminal G and the source terminal S of the drive transistor 121.

After the information of the threshold voltage Vth is written to the storage capacitor 120 and the drive transistor 121 cuts off, the driving scanning unit 105 changes the scanning driving pulse DS to the inactive-L state (t65). Thereafter, with the scanning driving pulse DS remaining in the inactive-L state, the horizontal driving unit 106 supplies the signal potential Vin of the video signal Vsig to the video signal line 106HS (t66V to t67V). Within the period during which the video signal Vsig is at the signal potential Vin (t66V to t67V), the writing scanning unit 104 sets the writing driving pulse WS in the active-H state to turn on the sampling transistor 125 (t66WS to t67WS).

Thereby the signal potential Vin is supplied to the gate terminal of the drive transistor 121. Therefore, the gate potential Vg of the drive transistor 121 changes from the offset voltage Vofs to the signal potential Vin, and information corresponding to the signal potential Vin is written to the storage capacitor 120. A period during which the writing driving pulse WS is in the active-H state (t66WS to t67WS) after the threshold value correcting operation is finished completely is a signal writing period K (sampling period) for writing the signal potential Vin to the storage capacitor 120. The signal potential Vin is retained by the storage capacitor 120 in such a manner as to be added to the threshold voltage Vth of the drive transistor 121.

Consequently, a variation in the threshold voltage Vth of the drive transistor 121 is cancelled, so that threshold value correction is made. As a result of this threshold value correction, the gate-to-source voltage Vgs retained by the storage capacitor 120 is "Vsig+Vth"="Vin+Vth".

Next, the driving scanning unit 105 changes the scanning driving pulse DS to the active-H state (t68). Thereby the light emission controlling transistor 122 is turned on. Therefore, a driving current Ids corresponding to the gate-to-source voltage Vgs (=Vin+Vth) at the point in time flows through the drive transistor 121, and thus an emission period L begins. In the emission period L, the gate potential Vg of the drive transistor 121 can change in such a manner as to be interlocked with the source potential Vs, and thus the bootstrap operation can be performed.

Thereafter, a transition is made to a next frame (or a next field), where the threshold value correction preparatory operation, the threshold value correcting operation, and the light emitting operation are repeated.

In the emission period B, L, the driving current Ids flowing through the drive transistor 121 flows to the organic EL element 127, and the anode potential of the organic EL element 127 rises according to the driving current Ids. Suppose that this rise is Vel. Eventually, as the source potential Vs rises, the reverse-biased state of the organic EL element 127 is cancelled. Thus, the driving current Ids flows into the organic EL element 127, whereby the organic EL element 127 actually starts emitting light. The rise (Vel) in the anode potential of the organic EL element 127 at this time is none other than the rise in the source potential Vs of the drive transistor 121. The source potential Vs of the drive transistor 121 is "Vofs−Vth+Vel".

The storage capacitor 120 is connected between the gate terminal G and the source terminal S of the drive transistor 121. Due to an effect of the storage capacitor 120, the bootstrap operation is performed, in which operation the gate potential Vg and the source potential Vs of the drive transistor 121 rise while the gate-to-source voltage "Vgs=Vin+Vth" of the drive transistor 121 is held constant. The source potential Vs of the drive transistor 121 becomes "Vofs−Vth+Vel", and thereby the gate potential Vg becomes "Vin+Vel".

A relation between the driving current Ids and the gate-to-source voltage Vgs can be expressed as in Equation (2) by substituting "Vin+Vth" for Vgs in Equation (1) expressing the above-described transistor characteristic. In Equation (2), k=(½)(W/L)Cox. Equation (2) shows that the term of the threshold voltage Vth is cancelled, and that the driving current Ids supplied to the organic EL element 127 is not dependent on the threshold voltage Vth of the drive transistor 121. The driving current Ids is basically determined by the signal potential Vin of the video signal Vsig. In other words, the organic EL element 127 emits light at a luminance corresponding to the signal potential Vin.

[Equation 2]

$$Ids=k\mu(Vgs-Vth)^2=k\mu^*\Delta Vin^2 \quad (2)$$

>Adverse Effect of Threshold Value Correcting Operation>

Figure 5:
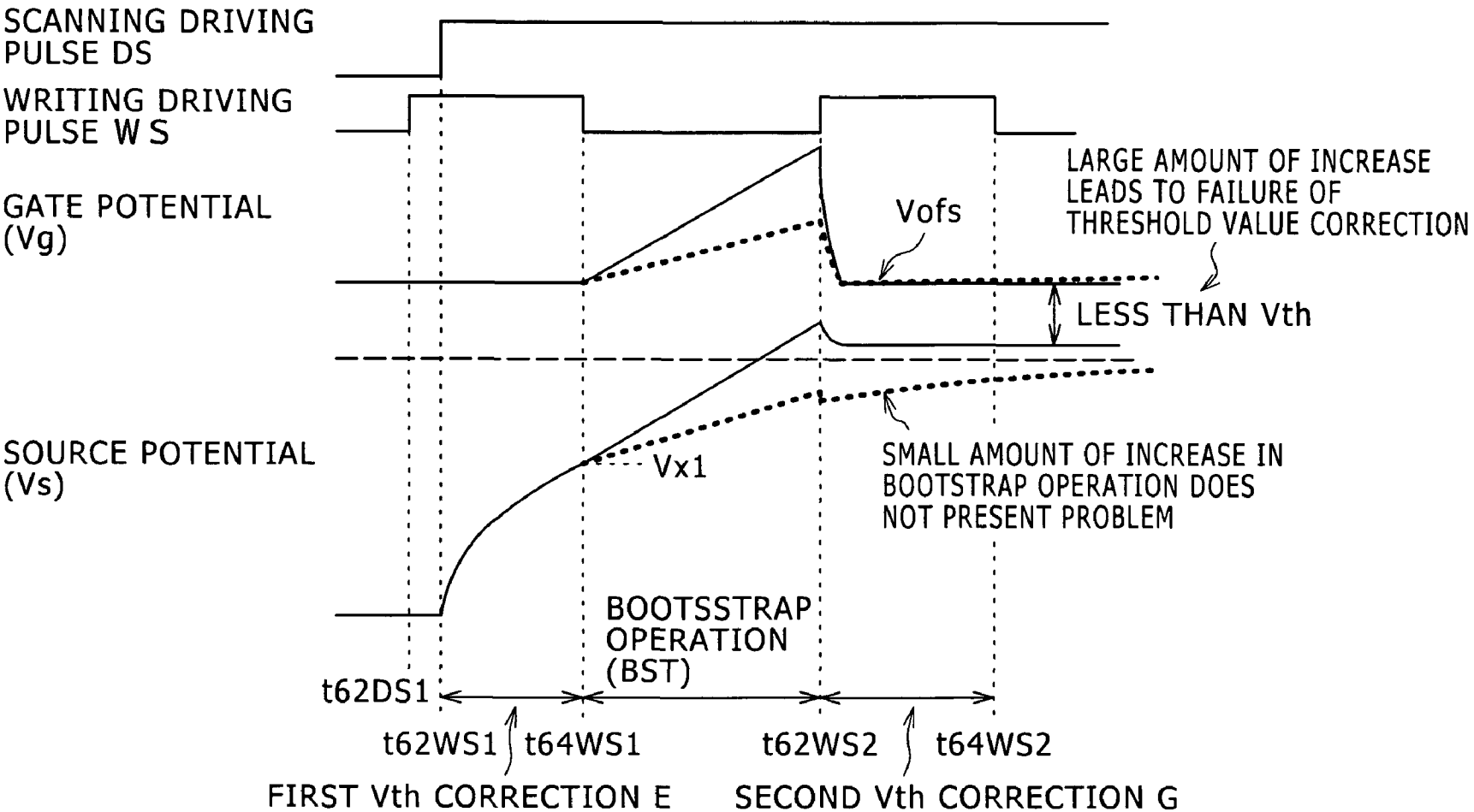
FIG. 5 is a diagram of assistance in explaining an adverse effect of threshold value correcting operation in the driving timing of the comparison example shown in FIG. 4.

FIG. 5 is a diagram of assistance in explaining an adverse effect of the threshold value correcting operation in the driving timing of the comparison example shown in FIG. 4. FIG. 5 is a timing chart showing in enlarged dimension a part of the plurality of threshold value correcting periods in the driving timing of the comparison example shown in FIG. 4.

The pixel circuit P according to the present embodiment employs a 4TR configuration, in which the number of transistors necessary for threshold value correction and mobility correction is smaller by one than in a 5TR configuration, whereby the number of circuit elements is reduced.

In this case, in making threshold value correction employing the 4TR configuration, the threshold value correcting operation is performed using the period (fixed signal period) of the offset voltage Vofs of the video signal Vsig in a pulse form assuming the two values of the offset voltage Vofs and the signal potential Vin within a 1 H period. In particular, in the driving timing of the comparison example, an operation of writing information of the threshold voltage Vth to the storage capacitor 120 by turning on the sampling transistor 125 in the period in which the video signal Vsig is at the offset voltage Vofs with the light emission controlling transistor 122 turned on is performed a plurality of times in respective 1 H periods.

Thus, suppose that as shown in FIG. 5, when a threshold value correcting operation is performed (t62WS to t64WS), the voltage corresponding to the threshold voltage Vth is not fully written to the storage capacitor 120 and thus "Vgs>Vth" in the threshold value correction. When the writing driving pulse WS is set in the inactive-L state (t64WS to t62WS), because the light emission controlling transistor 122 is on (scanning driving pulse DS=H level) and "Vgs>Vth", a drain current flows through the drive transistor 121, and a so-called bootstrap operation (described as BST in FIG. 5) in which the source potential Vs rises and the gate potential Vg also rises is performed.

Because the threshold value correcting operation is performed a plurality of times, when a period during which the video signal Vsig is at the offset voltage Vofs begins, the writing driving pulse WS is set in the active-H state to turn on the sampling transistor 125 again. Thereby the gate potential Vg is immediately returned to the offset voltage Vofs. On the other hand, the source potential Vs is raised by the threshold value correcting operation from a potential to which the source potential Vs has raised in the preceding bootstrap operation.

In this case, when a bootstrap operation after a certain threshold value correction causes the source potential Vs at a time of a start of a next threshold value correction to exceed "Vofs−Vth", the threshold value correcting operation fails, and thus the effect of the threshold value correction is not obtained. Even when a same signal potential Vin is given, the driving current Ids, that is, light emission luminance becomes different. Thus the uniformity of screen luminance is not obtained.

As indicated by a broken line in FIG. 5, for example, no problem is presented when an amount of increase in bootstrap operation is small. On the other hand, suppose that as indicated by a solid line in FIG. 5, a bootstrap operation after a first threshold value correction causes the source potential Vs at a time of a start of a second threshold value correction to exceed "Vofs−Vth". In this case, when the writing driving pulse WS is set in the active-H state and thereby the gate potential Vg is returned to the offset voltage Vofs to make the second threshold value correction, "Vg−Vs=Vgs<Vth". Therefore, the drive transistor 121 is in a cutoff state, and the threshold value correcting operation is not performed. The drive transistor 121 cuts off when the gate potential Vg returns to the offset voltage Vofs, so that the information of the threshold voltage Vth may not be correctly retained by the storage capacitor 120.

Accordingly, the present embodiment employs a mechanism that can prevent a failure of threshold value correcting operation as described above even when the operation of writing the information of the threshold voltage Vth to the storage capacitor 120 by turning on the sampling transistor 125 in the period in which the video signal Vsig is at the offset voltage Vofs with the light emission controlling transistor 122 turned on is performed a plurality of times in respective 1 H periods. A concrete description will be made in the following.

<Method of Preventing Failure of Threshold Value Correcting Operation which Failure is Attendant on Divided Threshold Value Correction>

Figure 6:
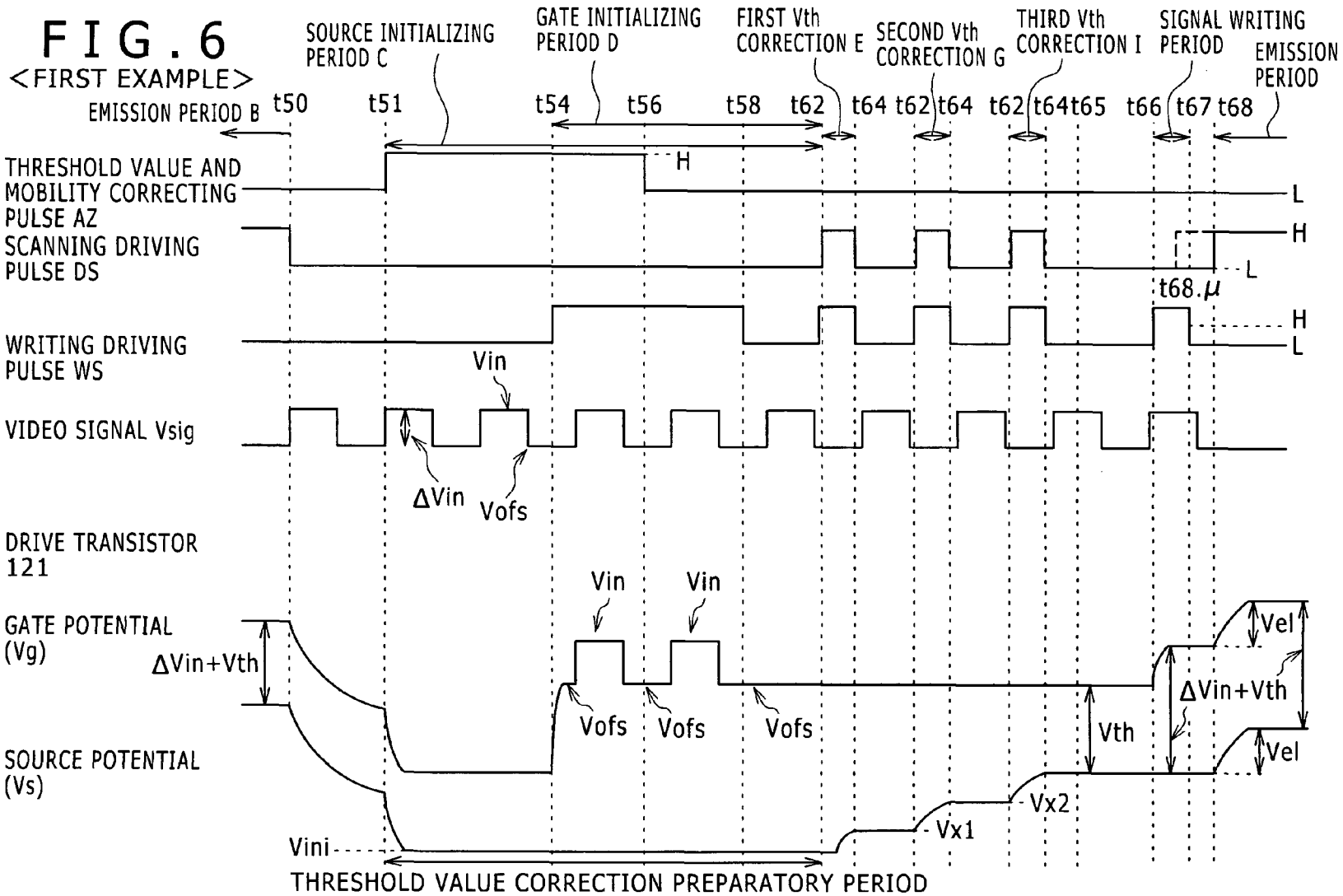
FIG. 6 is a timing chart of assistance in explaining driving timing of the pixel circuit according to the present embodiment.

FIG. 6 is a timing chart of assistance in explaining driving timing of the pixel circuit according to the present embodiment. FIG. 7 is a timing chart showing in enlarged dimension a part of a plurality of threshold value correcting periods in the driving timing of the present embodiment shown in FIG. 6. A method of preventing a phenomenon of a failure of threshold value correcting operation which failure is attendant on divided threshold value correction is applied to these timing charts.

As in the comparison example, the waveforms of the writing driving pulse WS, the threshold value & mobility correcting pulse AZ, and the scanning driving pulse DS are shown along a time axis t. As is understood from the above description, since the switching transistors 122, 124, and 125 are of an n-channel type, the switching transistors 122, 124, and 125 are on when the respective pulses DS, AZ, and WS are at a high (H) level, and are off when the respective pulses DS, AZ, and WS are at a low (L) level. Incidentally, this timing chart also shows the video signal Vsig, changes in potential at the gate terminal G of the drive transistor 121, and changes in potential at the source terminal S of the drive transistor 121 together with the waveforms of the respective pulses WS, AZ, and DS.

In description and figures, when different driving pulses occur in similar timing, for example, DS (in the case of the scanning driving pulse DS), AZ (in the case of the threshold value & mobility correcting pulse AZ), WS (in the case of the writing driving pulse WS), and V (in the case of the video signal Vsig) for distinguishing the respective driving pulses are attached as occasions demand.

In the driving timing to which the method of preventing a failure of threshold value correction according to the present embodiment is applied, as in the comparison example, a period during which the video signal Vsig is at the offset voltage Vofs (which voltage is the same in all horizontal periods), which period is a non-effective period (fixed signal period), is set as a first half part of one horizontal period, and a period during which the video signal Vsig is at the signal potential Vin (which potential is different in each horizontal period), which period is an effective period, is set as a second half part of one horizontal period. That is, the video signal Vsig is a pulse assuming the two values of the offset voltage Vofs and the signal potential Vin in a 1 H period.

A divided threshold value correction is made in which an operation of writing information of the threshold voltage Vth to the storage capacitor 120 by setting the scanning driving pulse DS in the active-H state to turn on the light emission controlling transistor 122 and setting the writing driving pulse WS in the active-H state to turn on the sampling transistor 125 during a period of the offset voltage Vofs according to the video signal Vsig that repeats the offset voltage Vofs and the signal potential Vin is performed a plurality of times in respective horizontal periods.

At the time of this divided threshold value correction, the threshold value correction failure preventing method according to the present embodiment has a characteristic in that bootstrap operation does not occur at all during intervals between threshold value correcting operations of the divided threshold value correction by holding the scanning driving pulse DS in the inactive-L state and thereby keeping the light emission controlling transistor 122 off during the intervals between the threshold value correcting operations. In the comparison example, the scanning driving pulse DS continues being in the active-H state and thus the light emission controlling transistor 122 is kept on during the period of the divided threshold value correcting operation. In the present embodiment, the scanning driving pulse DS is also subjected to on/off control in such a manner as to be interlocked with on/off control of the writing driving pulse WS for threshold value correction. Description in the following will be made centering on differences from the comparison example.

Operation up to a threshold value correction preparatory period is the same as in the comparison example. After completion of preparatory operation for the threshold value correction, the vertical driving unit 103 changes the writing driving pulse WS to the active-H state by the writing scanning unit 104 to turn on the sampling transistor 125 (t62WS1 to t64WS1) in such a manner as to coincide with timing in which the video signal Vsig is at the offset voltage Vofs (t62V1 to t64V1). In addition, the vertical driving unit 103 changes the scanning driving pulse DS to the active-H state by the driving scanning unit 105 to turn on the light emission controlling transistor 122 (t62DS1 to t64DS1) in such a manner as to coincide with timing in which the video signal Vsig is at the offset voltage Vofs (t62V1 to t64V1).

A relation between the start timings t62WS and t62DS and a relation between the end timings t64WS and t64DS in each threshold value correcting operation will be described later. Incidentally, preferably, the period during which the writing driving pulse WS and the scanning driving pulse DS are in the active-H state (t62WS to t64WS and t62DS to t64DS) is completely included within the time period during which the video signal Vsig is at the offset voltage Vofs (t62V to t64V).

Thereby a first threshold value correcting period E begins in which a drain current is used to charge or discharge the storage capacitor 120 and the organic EL element 127, and in which information for correcting (cancelling) the threshold voltage Vth of the drive transistor 121 is recorded in the storage capacitor 120.

The first threshold value correcting period E ends when the gate-to-source voltage Vgs becomes Vx1 (>Vth), that is, when the source potential Vs of the drive transistor 121 has changed from the reference potential Vini on a low potential side to "Vofs−Vx1" without the information corresponding to the threshold voltage Vth being recorded in the storage capacitor 120. Thus, Vx1 is written to the storage capacitor 120 at a point in time when the first threshold value correcting period E is completed (t64WS1 and t64DS1).

During an interval between the end of the first threshold value correcting period E (t62WS1 to t64WS1 and t62DS1 to t64DS1) and a start of a second threshold value correcting period G, not only the sampling transistor 125 but also the light emission controlling transistor 122 is off, so that unlike the comparison example, bootstrap operation does not occur at all. Hence, the source potential Vs when the second threshold value correcting period G begins is the source potential Vs (=Vofs−Vx1) at the time of the end of the first threshold value correcting period E. The second threshold value correcting operation begins at the source potential Vs (=Vofs−Vx1) at the time of the end of the first threshold value correcting period E.

The second threshold value correcting period G (t62WS2 to t64WS2 and t62DS2 to t64DS2) ends when the gate-to-source voltage Vgs becomes Vx2 (>Vth), that is, when the source potential Vs of the drive transistor 121 has changed from "Vofs−Vx1" to "Vofs−Vx2" without the information corresponding to the threshold voltage Vth being recorded in the storage capacitor 120 sufficiently. Thus, Vx2 is written to the storage capacitor 120 at a point in time when the second threshold value correcting period G is completed (t64WS2 and t64DS2).

During an interval between the end of the second threshold value correcting period G (t62WS2 to t64WS2 and t62DS2 to t64DS2) and a start of a third threshold value correcting period I, not only the sampling transistor 125 but also the light emission controlling transistor 122 is off, so that unlike the comparison example, bootstrap operation does not occur at all. Hence, the source potential Vs when the third threshold value correcting period I begins is the source potential Vs (=Vofs−Vx2) at the time of the end of the second threshold value correcting period G. The third threshold value correcting operation begins at the source potential Vs (=Vofs−Vx2) at the time of the end of the second threshold value correcting period G.

In the third threshold value correcting period I (t62WS3 to t64WS3 and t62DS3 to t64DS3), the source potential Vs of the drive transistor 121 rises from the source potential Vs (=Vofs−Vx2) at the time of the end of the second threshold value correcting period G, and a drain current flows until the drive transistor 121 cuts off. The drain current is cut off when the gate-to-source voltage Vgs becomes exactly the threshold voltage Vth. When the drain current is cut off, the source potential Vs of the drive transistor 121 becomes "Vofs−Vth".

In each of the three threshold value correcting periods E, G, and I, the organic EL element 127 is made to maintain the reverse-biased state by making a setting such that "Vofs−Vth<VthEL+Vcath" as described above so as to make the organic EL element 127 cut off, that is, so as to prevent the source potential Vs in the threshold value correcting periods E, G, and I from exceeding the threshold voltage VthEL of the organic EL element 127 so that the drain current flows to the storage capacitor 120 side (when Cs<<Cel) and does not flow to the organic EL element 127 side.

When the organic EL element 127 is set in the reverse-biased state in the threshold value correcting periods E, G, and I, the organic EL element 127 is in a cutoff state (a high-impedance state) and therefore does not emit light, and the organic EL element 127 exhibits a simple capacitance characteristic rather than a diode characteristic. Hence, the drain current (driving current Ids) flowing through the drive transistor 121 is written to a capacitance "C=Cs+Cel" obtained by combining both of the capacitance value Cs of the storage capacitor 120 and the capacitance value Cel of the parasitic capacitance (equivalent capacitance) Cel of the organic EL element 127. Thereby the drain current of the drive transistor 121 flows into the parasitic capacitance Cel of the organic EL element 127 and starts a charge. As a result, the source potential Vs of the drive transistor 121 rises.

After the third threshold value correcting period I, as in the comparison example, with the scanning driving pulse DS remaining in the inactive-L state, the sampling transistor 125 is turned on within a period during which the video signal Vsig is at the signal potential Vin (t66V to t67V), whereby the information of the signal potential Vin is written to the storage capacitor 120 (t66WS to t67WS). Thereafter the scanning driving pulse DS is changed to the active-H state to make a transition to an emission period L (t68).

The storage capacitor 120 is connected between the gate terminal G and the source terminal S of the drive transistor 121. Due to an effect of the storage capacitor 120, the bootstrap operation is performed at a start of the emission period, in which operation the gate potential Vg and the source potential Vs of the drive transistor 121 rise while the gate-to-source voltage "Vgs=Vin+Vth" of the drive transistor 121 is held constant. The source potential Vs of the drive transistor 121 becomes "−Vth+Vel", and thereby the gate potential Vg becomes "Vin+Vel".

The I-V characteristic of the organic EL element 127 is changed as the emission period becomes longer. Therefore the potential of the node ND121 is also changed. However, due to an effect of the storage capacitor 120, the potential of the node ND122 rises in such a manner as to be interlocked with a rise in the potential of the node ND121. The gate-to-source voltage Vgs of the drive transistor 121 is thus maintained at about "Vsig+Vth" at all times irrespective of rises in the potential of the node ND121.

Because the drive transistor 121 operates as a constant-current source, even when a secular change occurs in the I-V characteristic of the organic EL element 127, and the source potential Vs of the drive transistor 121 is changed correspondingly, the gate-to-source voltage Vgs of the drive transistor 121 is held constant (Vsig+Vth) by the storage capacitor 120. Therefore the current flowing through the organic EL element 127 is unchanged. Thus the light emission luminance of the organic EL element 127 is also held constant.

A bootstrap circuit functions as a driving signal uniformizing circuit for correcting changes in the current-voltage characteristic of the organic EL element 127 as an example of an electrooptic element and thereby maintaining the driving current at a constant level. In addition, a threshold value correcting circuit is formed. The detecting transistor 124 in the threshold value correcting period can act to cancel the threshold voltage Vth of the drive transistor 121 and thus send the constant current Ids unaffected by variations in the threshold voltage Vth. It is therefore possible to make a display at a stable gradation corresponding to an input pixel signal, and thus obtain an image of high image quality.

As a mechanism for threshold value correction, operation is performed within a plurality of horizontal scanning periods assigned to a plurality of rows, and the storage capacitor 120 is charged to the threshold voltage Vth on a time division basis. The sampling transistor 125 samples the video signal Vsig (signal potential Vin) supplied from the video signal line 106HS in the storage capacitor 120 during a signal supply period during which the video signal line 106HS (that is, the video signal Vsig) is at the signal potential Vin within a horizontal scanning period assigned to the writing scanning line 104WS as an object for signal writing.

On the other hand, a correcting section implemented by controlling the on/off timing of the light emission controlling transistor 122, the detecting transistor 124, and the sampling transistor 125 detects the threshold voltage Vth of the drive transistor 121 and charges the storage capacitor 120 to the threshold voltage Vth on a time division basis during fixed signal periods during which the signal line 106HS is at the offset voltage Vofs, which is a constant potential, within the respective horizontal scanning periods assigned to the writing scanning lines 104WS of a plurality of rows. The fixed signal periods during which the video signal Vsig is at the offset voltage Vofs divide horizontal scanning periods sequentially assigned to the respective signal lines 106HS from each other.

As an example, a fixed signal period can be assigned so as to include a horizontal blanking period, or may be a horizontal blanking period itself.

The correcting section charges the storage capacitor 120 to the threshold voltage Vth on a time division basis in fixed signal periods (periods of the offset voltage Vofs). After the correcting section charges the storage capacitor 120 in each fixed signal period, the sampling transistor 125 is preferably turned off (closed) to electrically disconnect the storage capacitor 120 from the signal line 106HS before the signal line 106HS changes from the offset voltage Vofs as constant potential to the signal potential Vin. By cancelling the application of the video signal Vsig, the gate potential Vg of the drive transistor 121 can rise, so that the bootstrap operation in which the gate potential Vg of the drive transistor 121 rises with the source potential Vs can be performed. Incidentally, it is needless to say that the sampling transistor 125 is turned on during a signal writing period K.

In the driving timing of the present embodiment, the threshold value correcting operation (the operation of retaining the information of the threshold voltage Vth in the storage capacitor 120) is performed a plurality of times as in the comparison example. However, the scanning driving pulse DS in the plurality of threshold value correcting periods behaves differently from that of the comparison example, and is turned on/off in such a manner as to be interlocked with the writing driving pulse WS.

Before the information corresponding to the threshold voltage Vth is correctly written to the storage capacitor 120 in the plurality of threshold value correcting periods and the drive transistor 121 cuts off, not only the sampling transistor 125 but also the light emission controlling transistor 122 is turned off and thus the bootstrap operation does not occur at all during intervals between the threshold value correcting periods. The source potential Vs when a next threshold value correcting period begins is the source potential Vs at a time of an end of a previous threshold value correcting period. The next threshold value correcting operation begins at the source potential Vs at the time of the end of the previous threshold value correcting period. It is therefore possible to prevent the phenomenon of failure of the threshold value correcting operation which failure is attendant on the divided threshold value correction and caused by the bootstrap operation occurring during the intervals between the threshold value correcting periods as in the comparison example. By preventing the bootstrap operation during the intervals between the threshold value correcting periods, it is possible to cancel changes or variations in the threshold voltage Vth of the drive transistor 121 and thus eliminate luminance non-uniformity without causing a failure of threshold value correction.

Figure 7A:
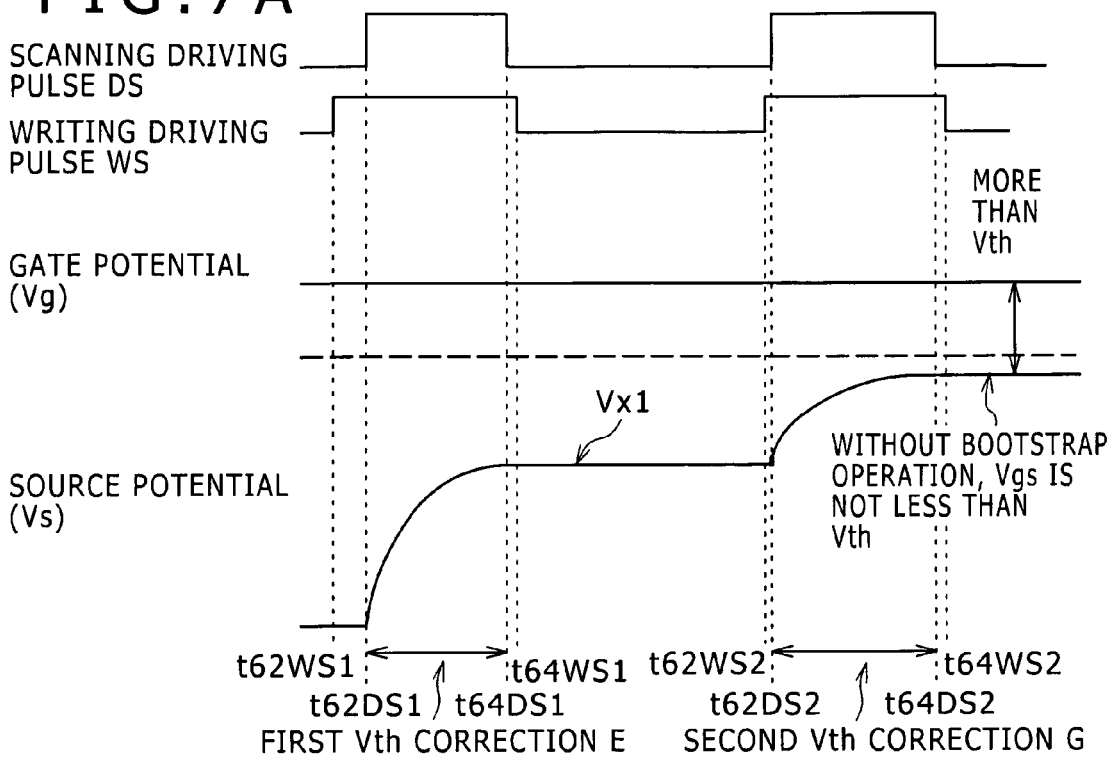
FIGS. 7A and 7B are timing charts showing in enlarged dimension a part of a plurality of threshold value correcting periods in the driving timing of the present embodiment shown in FIG. 6.

In this case, as for a relation between the timing t62WS1 and the timing t62DS1, it suffices for the timing t62WS1 and the timing t62DS1 to be substantially the same, or the timing t62WS1 and the timing t62DS1 may be temporally somewhat close to each other. Similarly, as for a relation between the timing t64WS1 and the timing t64DS1, it suffices for the timing t64WS1 and the timing t64DS1 to be substantially the same, or the timing t64WS1 and the timing t64DS1 may be temporally somewhat close to each other. When there is a lag, the threshold value correcting period is defined by an overlap period during which the scanning driving pulse DS and the writing driving pulse WS are both in the active-H state. From a viewpoint of completely preventing bootstrap operation during the intervals between the threshold value correcting periods of the divided threshold value correction, as shown in FIG. 7A, a period during which the scanning driving pulse DS is in the active-H state (t62DS to t64DS) is preferably completely included within a time period during which the writing driving pulse WS is in the active-H state (t62WS to t64WS).

Figure 7B:
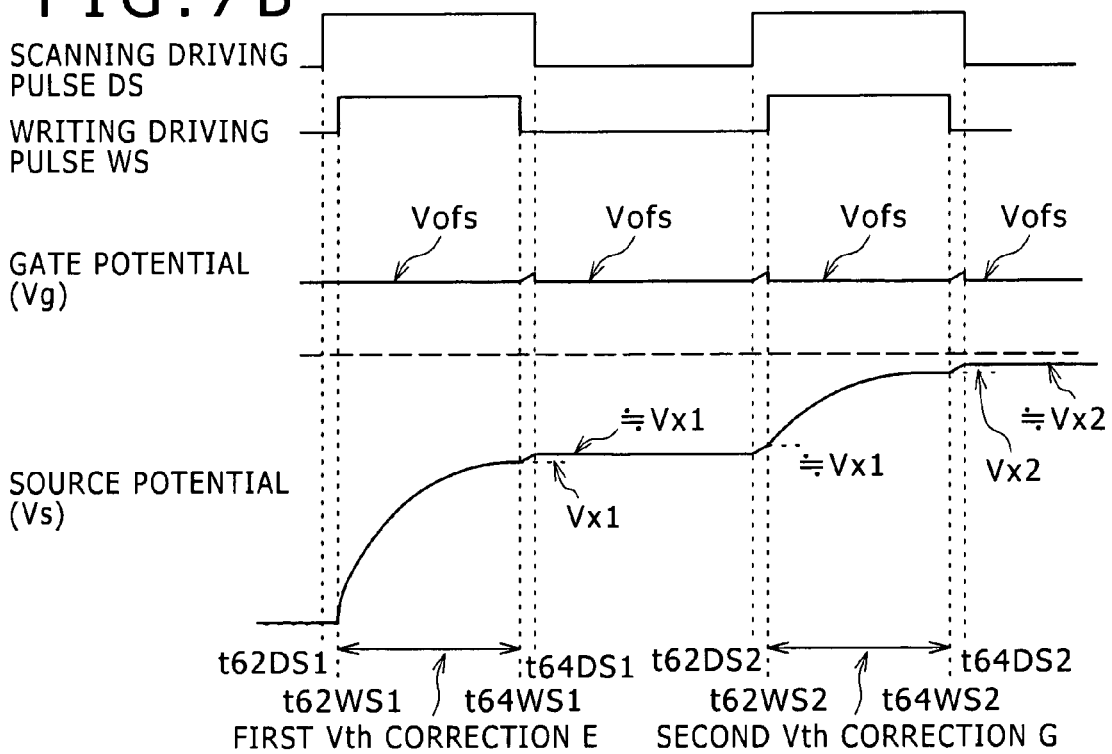

As shown in FIG. 7B, when there is a lag such that the timing t62DS in which the scanning driving pulse DS is set in the active-H state precedes the timing t62WS in which the writing driving pulse WS is set in the active-H state, or when there is a lag such that the timing t64DS in which the scanning driving pulse DS is set in the inactive-L state succeeds the timing t64WS in which the writing driving pulse WS is set in the inactive-L state, bootstrap operation is performed during the period of the lag (t62DS to t62WS or t64WS to t64DS).

Specifically, as shown in FIG. 5, because the light emission controlling transistor 122 is on (scanning driving pulse DS=H level) during the off period of the sampling transistor 125, and "Vgs>Vth", a drain current flows through the drive transistor 121, and the source potential Vs rises and the gate potential Vg also rises. However, when the period of the lag is short, a rise in the source potential Vs due to the bootstrap operation during this period is much smaller than in the comparison example, and may be considered to be no problem in operation.

Incidentally, while in the driving timing shown in FIG. 6, the signal writing period K is provided separately from the plurality of threshold value correcting periods, this is not essential. For example, a transition may be made to the signal writing period K continuously after the last threshold value correcting period (the third threshold value correcting period I in the foregoing example). Specifically, after the information of the threshold voltage Vth is written to the storage capacitor 120 and the drive transistor 121 cuts off, the first half part of one horizontal scanning period (the period of the offset voltage Vofs) passes, and then the video signal Vsig changes to the signal potential Vin. When the video signal Vsig is at the signal potential Vin, the information of the signal potential Vin is written to the storage capacitor 120.

Thus, while the writing driving pulse WS and the scanning driving pulse DS are set in the inactive-L state before the video signal Vsig changes to the signal potential Vin in each threshold value correcting operation (the first threshold value correcting operation and the second threshold value correcting operation in the present example) excluding the last threshold value correcting operation (the third threshold value correcting operation in the present example), the writing driving pulse WS is maintained in the active-H state even when the video signal Vsig changes to the signal potential Vin at the time of the last threshold value correcting operation in preparation for the writing of the signal potential Vin. The signal potential Vin is thereby supplied to the gate terminal of the drive transistor 121. Thus, the gate potential Vg of the drive transistor 121 is changed from the offset voltage Vofs to the signal potential Vin, and the information corresponding to the signal potential Vin is written to the storage capacitor 120.

<Provision for Mobility Correction>

Incidentally, when the timing t68 in which the scanning driving pulse DS is set in the active-H state, which timing defines a start of the emission period L, is set within the signal writing period K (t68μ: see a dotted line in FIG. 6), the light emission controlling transistor 122 is turned on while the sampling transistor 125 remains turned on after the information of the signal potential Vin is written to the storage capacitor 120 or simultaneously with the writing of the information of the signal potential Vin to the storage capacitor 120. Hence, a drain current can be made to flow through the drive transistor 121 while the information of the signal potential Vin is written to the storage capacitor 120. Thus a mobility correction can be performed which adds an amount of correction for the mobility of the drive transistor 121 to the driving signal written to the storage capacitor 120.

That is, the scanning driving pulse DS is set in the active-H state to turn on the light emission controlling transistor 122 before the timing t67WS in which the signal writing period K ends. The drain terminal D of the drive transistor 121 is thereby connected to the first power supply potential Vc1 via the light emission controlling transistor 122. The pixel circuit P therefore proceeds from the non-emission period to the emission period.

Thus, the mobility of the drive transistor 121 is corrected during a period t68μ to t67WS during which the sampling transistor 125 is still in the on state and the light emission controlling transistor 122 enters the on state. The correction of the mobility of the drive transistor 121 in each pixel is optimized by adjusting the period (referred to as a mobility correcting period) during which the active periods of the writing driving pulse WS and the scanning driving pulse DS overlap each other. That is, the mobility correction is performed properly during the period t68μ to t67WS during which a latter part of the signal writing period and a start part of the emission period coincide with each other.

At the start of the emission period in which the mobility correction is performed, the organic EL element 127 is actually in the reverse-biased state and thus does not emit light. During the mobility correcting period t68μ to t67WS, a driving current Ids flows through the drive transistor 121 with the gate terminal G of the drive transistor 121 fixed to a potential corresponding to the video signal Vsig (the signal potential Vin, to be exact).

In this case, by making a setting such that "Vofs−Vth<VthEL", the organic EL element 127 is set in the reverse-biased state, and thus exhibits a simple capacitance characteristic rather than a diode characteristic. Hence, the driving current Ids flowing through the drive transistor 121 is written to a capacitance "C=Cs+Cel" obtained by combining both of the capacitance value Cs of the storage capacitor 120 and the capacitance value Cel of the parasitic capacitance (equivalent capacitance) Cel of the organic EL element 127. Thereby the source potential Vs of the drive transistor 121 rises. Suppose that this rise is ΔV.

The rise ΔV, that is, an amount of negative feedback ΔV as a mobility correction parameter is eventually subtracted from the gate-to-source voltage Vgs retained by the storage capacitor 120, so that negative feedback is applied. The mobility μ can be corrected by thus negatively feeding back the driving current Ids of the drive transistor 121 to the gate-to-source voltage Vgs of the same drive transistor 121. Incidentally, the amount of negative feedback ΔV can be optimized by adjusting the duration of the mobility correcting period t68μ to t67WS.

The higher the level of the video signal Vsig, the higher the driving current Ids, and the higher the absolute value of ΔV. Hence, a mobility correction according to the level of light emission luminance can be made. In addition, when consideration is given to a drive transistor 121 of high mobility and a drive transistor 121 of low mobility, supposing that the video signal Vsig is fixed, the higher the mobility μ of the drive transistor 121, the higher the absolute value of ΔV.

In other words, the source potential of the drive transistor 121 of high mobility rises greatly during the mobility correcting period as compared with the drive transistor 121 of low mobility. In addition, the negative feedback is applied such that the larger the rise in source potential, the smaller the potential difference between the gate and the source, and thus the more difficult it becomes for the current to flow. Because the higher the mobility μ, the larger the amount of negative feedback ΔV, a variation in mobility μ in each pixel can be eliminated. Even the drive transistors 121 different in mobility can send the same driving current Ids through the organic EL element 127. The amount of negative feedback ΔV can be optimized by adjusting the mobility correcting period.

In the emission period L after the mobility correction, the gate terminal G of the drive transistor 121 is disconnected from the video signal line 106HS. Therefore, the application of the signal potential Vin to the gate terminal G of the drive transistor 121 is cancelled, and the gate potential Vg of the drive transistor 121 becomes able to rise. At this time, the driving current Ids flowing through the drive transistor 121 flows to the organic EL element 127, and the anode potential of the organic EL element 127 rises according to the driving current Ids. Suppose that this rise is Vel. At this time, the gate-to-source voltage Vgs of the drive transistor 121 is constant due to an effect of the storage capacitor 120, and thus the drive transistor 121 sends a constant current (driving current Ids) to the organic EL element 127. As a result, a voltage drop occurs, and the potential Vel at the anode terminal A of the organic EL element 127 (=the potential of the node ND121) rises to a voltage at which a current, or the driving current Ids, can flow through the organic EL element 127. Meanwhile, the gate-to-source voltage Vgs retained by the storage capacitor 120 maintains a value of "Vsig+Vth−ΔV".

Eventually, as the source potential Vs rises, the reverse-biased state of the organic EL element 127 is cancelled, and thus the driving current Ids flows into the organic EL element 127, whereby the organic EL element 127 actually starts emitting light. The rise (Vel) in the anode potential of the organic EL element 127 at this time is none other than the rise in the source potential Vs of the drive transistor 121. The source potential Vs of the drive transistor 121 is "−Vth+ΔV+Vel".

A relation between the driving current Ids and the gate voltage Vgs at the time of light emission can be expressed as in Equation (3) by substituting "Vsig+Vth−ΔV" for Vgs in Equation (1) expressing the above-described transistor characteristic.

[Equation 3]

$$Ids=k\mu(Vgs-Vth)^2=k\mu(\Delta Vin-\Delta V)^2 \quad (3)$$

In Equation (3), k=(½) (W/L)Cox. Equation (3) shows that the term of the threshold voltage Vth is cancelled, and that the driving current Ids supplied to the organic EL element 127 is not dependent on the threshold voltage Vth of the drive transistor 121. The driving current Ids is basically determined by the signal voltage Vsig of the video signal. In other words, the organic EL element 127 emits light at a luminance corresponding to the video signal Vsig. At this time, the video signal Vsig is corrected by the amount of feedback ΔV. The amount of correction ΔV acts exactly to cancel the effect of the mobility μ positioned in a coefficient part of Equation (3). Thus, the driving current Ids is in effect dependent on the video signal Vsig (signal potential Vin).

At this time, the signal potential Vin is corrected by the amount of feedback ΔV. This amount of correction ΔV acts exactly to cancel the effect of the mobility μ positioned in the coefficient part of Equation (3). Thus, the driving current Ids is in effect dependent on the signal potential Vin. Because the driving current Ids is not dependent on the threshold voltage Vth, even when the threshold voltage Vth is varied by a manufacturing process, the driving current Ids between the drain and the source is not varied, and thus the light emission luminance of the organic EL element 127 is not varied either.

By forming the mobility correcting circuit, as a result of the action during the mobility correcting period of the light emission controlling transistor 122 interlocked with the operation of writing the video signal Vsig by the sampling transistor 125 within the period of the signal potential Vin in one horizontal period of the offset voltage Vofs and the signal potential Vin, the gate-to-source voltage Vgs reflecting the carrier mobility μ of the drive transistor 121 can be set, and the constant current Ids unaffected by variations in the carrier mobility μ can be made to flow. It is therefore possible to make a display at a stable gradation corresponding to an input pixel signal, and thus obtain an image of high image quality.

While the present invention has been described above using embodiments thereof, the technical scope of the present invention is not limited to a scope described in the foregoing embodiments. Various changes and improvements can be made to the foregoing embodiments without departing from the spirit of the invention, and forms obtained by adding such changes and improvements are also included in the technical scope of the present invention.

In addition, the foregoing embodiments do not limit inventions of claims, and not all combinations of features described in the embodiments are necessarily essential to solving means of the invention. The foregoing embodiments include inventions in various stages, and various inventions can be extracted by appropriately combining a plurality of disclosed constitutional requirements. Even when a few constitutional requirements are omitted from all the constitutional requirements disclosed in the embodiments, constitutions resulting from the omission of the few constitutional requirements can be extracted as inventions as long as an effect is obtained.

<Examples of Modification of Pixel Circuit and Driving Timing>

For example a "duality principle" holds in circuit theory, and thus modifications can be made to the pixel circuit P from this viewpoint. In this case, though not shown in figures, while the pixel circuit P of the 4TR configuration shown in FIG. 2 includes an n-channel type drive transistor 121, a p-channel type drive transistor (hereinafter referred to as a p-type drive transistor 121*p*) is used to form a pixel circuit P. Accordingly, changes are made according to the duality principle, such for example as also making the other transistors 122, 124, and 125 p-channel type transistors supplied with an active-L driving pulse and reversing the polarity of the signal potential Vin of the video signal Vsig and the magnitude relation of power supply voltages.

As with the organic EL display device according to the basic example using the above-described n-type transistors, an organic EL display device according to the modification example using the p-type transistors to which the duality principle is applied can prevent a shading phenomenon attendant on threshold value correction by performing control in such a manner as to define a threshold value correcting period by the on period of the sampling transistor 125. Of course, shading due to gate coupling of the scanning driving pulse DS can be avoided. Hence, the light emission controlling transistor 122 can be operated in a linear region even in a threshold value correcting period, and thus specifications for the driving scanning unit do not have to be complicated.

It is to be noted that while the modification example described above is obtained by making changes to the 4TR configuration shown in FIG. 2 according to the "duality principle", a method of changing the circuit is not limited to this. For example, in the 4TR configuration shown in FIG. 2, it is possible to make only the light emission controlling transistor 122 a p-channel type, or make only the sampling transistor 125 a p-channel type. Similarly, in the modification example obtained by making changes to the 4TR configuration shown in FIG. 2 according to the "duality principle", it is possible to make only the light emission controlling transistor 122 an n-channel type, or make only the sampling transistor 125 an n-channel type. In either case, it suffices to control the drive transistor 121 such that a threshold value correcting period is defined by the on period of the sampling transistor during the threshold value correcting operation.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array unit including pixel circuits arranged in a form of a matrix, said pixel circuits each including a drive transistor for generating a driving current, an electrooptic element connected to an output terminal of said drive transistor, a storage capacitor for retaining information corresponding to a signal potential of a video signal, a sampling transistor for writing the information corresponding to said signal potential to said storage capacitor, and a light emission controlling transistor for adjusting an emission period of said electrooptic element, said light emission controlling transistor being disposed between a power supply terminal of said drive transistor and a power supply line, said drive transistor generating the driving current based on the information retained in said storage capacitor and sending the driving current through said electrooptic element, whereby said electrooptic element emits light; and a control unit including a writing scanning unit for outputting, to said sampling transistor, a writing scanning pulse for performing line-sequential scanning of said pixel circuits by sequentially controlling said sampling transistor and writing information corresponding to a signal potential of a video signal to each of storage capacitors in one row, and a horizontal driving unit for supplying a video signal for one row to a video signal line according to a signal potential writing operation of said sampling transistor;

wherein said control unit effects control to supply a control input terminal of said drive transistor with a fixed potential for a threshold value correcting operation for retaining a voltage corresponding to a threshold voltage of said drive transistor in said storage capacitor, and when setting a voltage across said storage capacitor to the threshold voltage of said drive transistor by repeating said threshold value correcting operation a plurality of times on a time division basis per said signal potential writing operation, said control unit effects control to perform each said threshold value correcting operation by changing said light emission controlling transistor and said sampling transistor to a conducting state in such a manner as to be interlocked with each other in periods in which said fixed potential is supplied during a period of a plurality of said threshold value correcting operations.

2. The display device according to claim 1, wherein said horizontal driving unit outputs the fixed potential for said threshold value correcting operation as said video signal in a part of a horizontal scanning period.

3. The display device according to claim 1, wherein prior to said threshold value correcting operation, said control unit effects control to perform a preparatory operation for said threshold value correcting operation, said preparatory operation setting the voltage across said storage capacitor to the threshold voltage of said drive transistor or higher.

4. The display device according to claim 3, wherein said pixel circuit has said storage capacitor disposed between the control input terminal and said output terminal of said drive transistor, and has a switch transistor disposed between a reference potential for setting the voltage across said storage capacitor to the threshold voltage of said drive transistor or higher and said output terminal of said drive transistor, in addition to said drive transistor, said sampling transistor, and said light emission controlling transistor, and said control unit sets said switch transistor in a conducting state during the preparatory operation for said threshold value correcting operation.

5. The display device according to claim 1, wherein after said threshold value correcting operation, said control unit effects control to perform mobility correcting operation for adding an amount of correction for mobility of said drive transistor to the information written to said storage capacitor.

6. The display device according to claim 1, wherein said control unit stops supplying said video signal to said control input terminal of said drive transistor by setting said sampling transistor in a non-conducting state at a point in time at which the information corresponding to said signal potential is written to said storage capacitor, and enables an operation in which potential of said control input terminal of said drive transistor is interlocked with change in potential of said output terminal of said drive transistor.

7. A driving method of a pixel circuit, said pixel circuit including a drive transistor for generating a driving current, an electrooptic element connected to an output terminal of said drive transistor, a storage capacitor for retaining information corresponding to a signal potential of a video signal, a sampling transistor for writing the information corresponding to said signal potential to said storage capacitor, and a light emission controlling transistor for adjusting an emission period of said electrooptic element, said light emission controlling transistor being disposed between a power supply terminal of said drive transistor and a power supply line, said drive transistor generating the driving current based on the information retained in said storage capacitor and sending the driving current through said electrooptic element, whereby said electrooptic element emits light, said driving method comprising:

a control unit effecting control to supply a control input terminal of said drive transistor with a fixed potential for a threshold value correcting operation for retaining a voltage corresponding to a threshold voltage of said drive transistor in said storage capacitor, and when setting a voltage across said storage capacitor to the threshold voltage of said drive transistor by repeating said threshold value correcting operation a plurality of times on a time division basis per said signal potential writing operation, said control unit effecting control to perform each said threshold value correcting operation by changing said light emission controlling transistor and said sampling transistor to a conducting state in such a manner as to be interlocked with each other in periods in which said fixed potential is supplied during a period of a plurality of said threshold value correcting operations.

8. A display device comprising:

pixel array means for including pixel circuits arranged in a form of a matrix, said pixel circuits each including a drive transistor for generating a driving current, an electrooptic element connected to an output terminal of said drive transistor, a storage capacitor for retaining information corresponding to a signal potential of a video signal, a sampling transistor for writing the information corresponding to said signal potential to said storage capacitor, and a light emission controlling transistor for adjusting an emission period of said electrooptic element, said light emission controlling transistor being disposed between a power supply terminal of said drive transistor and a power supply line, said drive transistor generating the driving current based on the information retained in said storage capacitor and sending the driving current through said electrooptic element, whereby said electrooptic element emits light; and control means for including a writing scanning unit for outputting, to said sampling transistor, a writing scanning pulse for performing line-sequential scanning of said pixel circuits by sequentially controlling said sampling transistor and writing information corresponding to a signal potential of a video signal to each of storage capacitors in one row, and a horizontal driving unit for supplying a video signal for one row to a video signal line according to a signal potential writing operation of said sampling transistor;

wherein said control means effects control to supply a control input terminal of said drive transistor with a fixed potential for a threshold value correcting operation for retaining a voltage corresponding to a threshold voltage of said drive transistor in said storage capacitor, and when setting a voltage across said storage capacitor to the threshold voltage of said drive transistor by repeating said threshold value correcting operation a plurality of times on a time division basis per said signal potential writing operation, said control means effects control to perform each said threshold value correcting operation by changing said light emission controlling transistor and said sampling transistor to a conducting state in such a manner as to be interlocked with each other in periods in which said fixed potential is supplied during a period of a plurality of said threshold value correcting operations.

9. A display device comprising:

a plurality of scanning lines, a plurality of signal lines, a power supply line, a pixel array unit including pixel circuits arranged in a matrix form, each of said pixel circuits including a drive transistor, an electro-optical element, a storage capacitor, a sampling transistor, and a controlling transistor being disposed between said electro-optical element and said power supply line; and a control unit;

wherein said control unit is configured to supply a fixed potential to said storage capacitor via said sampling transistor for a correcting operation for retaining a voltage corresponding to a threshold voltage of said drive transistor in said storage capacitor, and is configured to supply a signal potential to said storage capacitor via said sampling transistor for a writing operation, wherein said control unit is configured to repeat said correcting operation a plurality of times per each of said writing operation, and wherein said controlling transistor and said sampling transistor are both configured to set in a non-conducting state in periods in which said signal line is at the signal potential during a correcting period including a plurality of said correcting operations.

* * * * *